US008568195B1

(12) United States Patent
Schindler

(10) Patent No.: US 8,568,195 B1
(45) Date of Patent: Oct. 29, 2013

(54) MULTI-FABRIC GARMENT

(75) Inventor: Heather Thomson Schindler, New York, NY (US)

(73) Assignee: Times Three Clothier, LLC, New York, NY (US)

( * ) Notice: Subject to any disclaimer, the term of this patent is extended or adjusted under 35 U.S.C. 154(b) by 1027 days.

(21) Appl. No.: 12/353,752

(22) Filed: Jan. 14, 2009

Related U.S. Application Data

(60) Provisional application No. 61/021,212, filed on Jan. 15, 2008.

(51) Int. Cl.
*A41C 1/06* (2006.01)

(52) U.S. Cl.
USPC ..... 450/30; 450/33; 450/7

(58) Field of Classification Search
USPC ..... 450/96–112, 7–11, 30–33; 2/67, 69, 2/78.1–78.4, 113, 115, 105, 106, 109, 73
See application file for complete search history.

(56) References Cited

U.S. PATENT DOCUMENTS

| | | | | | |
|---|---|---|---|---|---|
| 357,068 | A | | 2/1887 | Dalby | |
| 570,696 | A | | 11/1896 | Brown | |
| 933,739 | A | | 9/1909 | Bodensiek | |
| 1,110,749 | A | | 9/1914 | De Blieux | |
| 1,121,005 | A | | 12/1914 | Farnsworth | |
| 1,191,865 | A | | 7/1916 | Workman | |
| 1,249,446 | A | * | 12/1917 | McGill | 2/78.1 |
| 1,774,613 | A | * | 9/1930 | Pidgeon | 450/20 |
| 1,777,215 | A | * | 9/1930 | Mcgill | 2/78.3 |
| 1,813,043 | A | | 7/1931 | Foreman | |
| 1,886,049 | A | | 11/1932 | Rothblum | |
| D91,329 | S | | 5/1933 | Redman | |
| 1,931,822 | A | * | 10/1933 | Hoffman | 450/95 |
| 1,977,329 | A | * | 10/1934 | Tobin | 2/113 |
| 2,033,456 | A | * | 3/1936 | Cunningham | 2/67 |
| 2,040,058 | A | | 5/1936 | Mendel et al. | |
| 2,052,935 | A | * | 9/1936 | Moran | 450/10 |
| 2,076,748 | A | | 4/1937 | Schweig | |
| 2,097,777 | A | | 11/1937 | Rothman | |
| D110,662 | S | | 7/1938 | Rielly | |
| 2,190,030 | A | | 2/1940 | Kops | |
| D128,536 | S | | 7/1941 | Weil | |
| D129,894 | S | | 10/1941 | Abeles | |

(Continued)

FOREIGN PATENT DOCUMENTS

| | | |
|---|---|---|
| DE | G8513103.2 | 8/1985 |
| DE | 202005000716 U1 | 4/2005 |

(Continued)

OTHER PUBLICATIONS

Nike Fly Lightweight + Women's Sports Top, Nike, http://clothing-and-accessories.become.com/nike-fly-lightweight-womens-sports-top—com . . . (URL is incomplete) received by Applicant Aug. 24, 2010.

(Continued)

*Primary Examiner* — Gloria Hale
(74) *Attorney, Agent, or Firm* — Stroock & Stroock & Lavan LLP

(57) ABSTRACT

A multi-fabric garment for slenderizing the midsection of a user includes a noncompressive upper section, a slenderizing compressive middle section, and a noncompressive lower section. The slenderizing middle section can include both compressive and noncompressive materials.

77 Claims, 34 Drawing Sheets

(56) References Cited

U.S. PATENT DOCUMENTS

| | | | | | |
|---|---|---|---|---|---|
| 2,274,382 | A | | 2/1942 | Richman | |
| 2,310,103 | A | * | 2/1943 | McDonald | 2/113 |
| 2,335,751 | A | * | 11/1943 | Friedman | 2/73 |
| 2,579,547 | A | * | 12/1951 | Cadous | 450/112 |
| D170,694 | S | | 10/1953 | Kahn | |
| D174,038 | S | | 2/1955 | Goldstein | |
| D174,114 | S | | 3/1955 | Dior | |
| D174,115 | S | | 3/1955 | Dior | |
| D174,194 | S | | 3/1955 | Prochaska | |
| D177,982 | S | | 6/1956 | Kahn | |
| 2,923,302 | A | | 2/1960 | Clark | |
| 2,963,022 | A | * | 12/1960 | Spetalnik | 450/15 |
| D191,347 | S | | 9/1961 | Herman | |
| 3,026,875 | A | * | 3/1962 | Kaupp | 450/116 |
| 3,036,574 | A | * | 5/1962 | Jeffrey | 450/30 |
| 3,060,446 | A | | 10/1962 | Home | |
| 3,066,675 | A | | 12/1962 | Herman | |
| 3,217,713 | A | | 11/1965 | Kunel | |
| D211,231 | S | | 6/1968 | Salisky | |
| 3,421,513 | A | | 1/1969 | Landau | |
| 3,422,818 | A | | 1/1969 | Erteszek | |
| 3,454,013 | A | * | 7/1969 | Cahill | 450/116 |
| 3,479,844 | A | * | 11/1969 | Andre | 66/176 |
| 3,556,106 | A | * | 1/1971 | Rosner | 450/30 |
| 3,582,993 | A | | 6/1971 | Keller | |
| 3,677,252 | A | | 7/1972 | Pedley | |
| 3,699,590 | A | * | 10/1972 | Webber et al. | 361/220 |
| D234,649 | S | | 4/1975 | Cascio | |
| D239,475 | S | | 4/1976 | Cascio | |
| 3,949,426 | A | | 4/1976 | George | |
| 4,377,007 | A | | 3/1983 | Sudjian | |
| 4,916,755 | A | * | 4/1990 | Feigenbaum et al. | 2/67 |
| 4,976,653 | A | | 12/1990 | White | |
| 5,083,316 | A | * | 1/1992 | Kuehner | 2/67 |
| 5,094,648 | A | | 3/1992 | Turner | |
| 5,461,725 | A | | 10/1995 | Witczak | |
| 5,566,392 | A | * | 10/1996 | Dzelzkalns | 2/73 |
| 5,605,060 | A | | 2/1997 | Osborne | |
| D391,740 | S | | 3/1998 | Barrington et al. | |
| 5,915,531 | A | * | 6/1999 | Hilpert et al. | 2/69 |
| 6,000,993 | A | * | 12/1999 | Erwin | 450/7 |
| 6,061,832 | A | * | 5/2000 | Morrison, Jr. | 2/78.1 |
| 6,185,741 | B1 | * | 2/2001 | Kehoe | 2/67 |
| D452,600 | S | | 1/2002 | Kim | |
| D453,058 | S | | 1/2002 | Kim | |
| D453,255 | S | | 2/2002 | Kim | |
| 6,430,748 | B1 | * | 8/2002 | Burkhart | 2/78.1 |
| D476,464 | S | | 7/2003 | Jenkins | |
| 6,846,217 | B1 | * | 1/2005 | Struble et al. | 450/31 |
| D556,978 | S | | 12/2007 | Thunstedt | |
| 7,395,557 | B1 | * | 7/2008 | Ledyard | 2/113 |
| D595,480 | S | | 7/2009 | Giugliano | |
| D606,285 | S | | 12/2009 | Schindler | |
| D616,627 | S | | 6/2010 | Schindler | |
| D622,477 | S | | 8/2010 | Schindler | |
| D623,377 | S | | 9/2010 | Schindler | |
| D632,051 | S | | 2/2011 | Schindler | |
| D632,052 | S | | 2/2011 | Schindler | |
| D632,053 | S | | 2/2011 | Schindler | |
| D656,298 | S | | 3/2012 | Schindler | |
| D665,558 | S | | 8/2012 | Schindler | |
| D666,384 | S | | 9/2012 | Schindler | |
| D667,607 | S | | 9/2012 | Schindler | |
| 2006/0242748 | A1 | | 11/2006 | Martz | |
| 2007/0094765 | A1 | * | 5/2007 | Summers et al. | 2/113 |
| 2008/0134409 | A1 | * | 6/2008 | Karasina | 2/117 |
| 2008/0244805 | A1 | * | 10/2008 | Griffin | 2/74 |

FOREIGN PATENT DOCUMENTS

| | | | |
|---|---|---|---|
| EP | 0174179 | | 3/1986 |
| EP | 0774241 | | 5/1997 |
| EP | 1082951 | | 3/2001 |
| EP | 1125566 | | 8/2001 |
| EP | 000385562-0106 | | 7/2005 |
| EP | 000454202-0027 | | 12/2005 |
| EP | 000454202-0121 | | 12/2005 |
| EP | 000633755-0027 | | 12/2006 |
| EP | 000730403-0023 | | 5/2007 |
| GB | 116526 | | 6/1918 |
| GB | 212307 | | 3/1924 |
| GB | 1603600 | | 11/1981 |
| GB | 3020687 | | 7/2005 |
| GB | 4004524 | | 10/2007 |
| JP | 2-82707 | | 6/1990 |
| JP | 2001-172806 | | 6/2001 |
| JP | 2002-138302 | | 5/2002 |
| JP | 2003-129303 | A | 5/2003 |
| JP | 2005-281893 | A | 10/2005 |
| JP | 2006-316359 | | 11/2006 |
| JP | 2006-316359 | A | 11/2006 |
| JP | 2007-146337 | | 6/2007 |
| JP | 2007-146337 | A | 6/2007 |
| JP | 2007-303002 | | 11/2007 |
| JP | 2008-156812 | A | 7/2008 |
| WO | 96/08217 | | 3/1996 |
| WO | 01/75201 | | 10/2001 |

OTHER PUBLICATIONS

Pretty Shapewear Camisole, SassyBax, www.sassybax.com/pretty-camisole.php received by Applicant Aug. 24, 2010.

Underwire Torso Trim, SassyBax, www.sassybax.com/underwire_trim.php received by Applicant Aug. 24, 2010.

The Torso Trim, SassyBax, www.sassybax.com/torso_trim.php received by Applicant Aug. 24, 2010.

Belly Bra, JCPenney, www.jcpenney.com/jcp/X6.aspx?DeptID=51669&CatID=51669&Grptyp=Siz&Item . . . (URL is incomplete) received by Applicant Aug. 24, 2010.

Secret Sculptor Tunic, Shape Fx, www.shapefx.com/store/Shapewear_Shop_by_Category_Camis_Tanks_Se . . . (URL is incomplete) received by Applicant Aug. 24, 2010.

The Skinny, www.skinnycami.biz/files/ received by Applicant Aug. 24, 2010.

Slimplicity Lingerie Strap Camisole, Spanx, www.spanx.com/product/index.jsp?productId=3977353&cp=2992553.4015964‖ . . . (URL is incomplete) received by Applicant Aug. 24, 2010.

Hide & Sleek Cami, Spanx, http://web.archive.org/ . . . (URL is incomplete) received by Applicant Aug. 24, 2010.

Hide & Sleek Full Slip 18 Inch 060A, Spanx, www.herroom.com/Spanx-060A-Hide-Sleek-Full-Slip-18-Inch.shtml received by Applicant Aug. 24, 2010.

Teez-Her the Skinny Tank, Teez-Her, www.essentialapparel.com/index.cfm/a/catalog.prodshow/vid/72638/catid/267/Teez . . . (URL is incomplete) received by Applicant Aug. 24, 2010.

Cami-Rolls, http://camirolls.com/shop.shtml received by Applicant Aug. 24, 2010.

TummyTee, www.redefyne.com/tummytee.html received by Applicant Aug. 24, 2010.

Champion Seamless Empire Top with Built-In Sports Bra, Champion, www.championusa.com/Champion/Products/Women-Champion/Women_ShopByCa . . . (URL is incomplete) received by Applicant Aug. 24, 2010.

Cosabella Smooth Bodyshaper Cami SHPE702, CosaBella, www.herroom.com/Cosabella-Shpe702-Smooth-Bodyshaper-Cami.shtml received by Applicant Aug. 24, 2010.

Daisy Fuentes Slimming Camisole, Kohls, www.kohls.com/upgrade/webstore/product_page.jsp?PRODUCT%3C%3Eprd_id=8 received by Applicant Aug. 24, 2010.

582L Countouring Balconet Bra Cami-Long Torso, Dumi Shapewear, www.du-mi.com/store/product-info.php?pid12.html received by Applicant Aug. 24, 2010.

Very Precious, Great Glam, http://greatglam.com/pd-very-precious.cfm received by Applicant Aug. 24, 2010.

Sensual Charm, Great Glam, http://greatglam.com/pd-sensual-charm1.cfm received by Applicant Aug. 24, 2010.

Yalof Schwartz, Suze, "Too Busy for the Gym?" Glamour, www.glamour.com/fashion/blogs/slaves-to-fashion/2007/10/too-bus . . . (URL is incomplete) received by Applicant Aug. 24, 2010.

(56) References Cited

OTHER PUBLICATIONS

Underwire Torso Trim, Sassybax, http://webarchive.org/web/20071020033219/sassybax.com received by Applicant Aug. 24, 2010.
Nancy Ganz the Belly Band Convertible Bodybriefer 3313, Nancy Ganz, www.herroom.com/NancyGanz . . . (URL is incomplete) received by Applicant Aug. 24, 2010.
Spanx Hide & Sleek Full Slip 060A, Spanx, www.herroom.com/Spanx-Hide . . . (URL is incomplete) received by Applicant Aug. 24, 2010.
Spanx Hide & Sleek Cami 050, Spanx, www.herroom.com/Spanx . . . (URL is incomplete) received by Applicant Aug. 24, 2010.
Collection of Photographs received by Applicant (submitted in 3 parts) on Dec. 8, 2010 received by Applicant Aug. 24, 2010.
Alleged Ann Mason Receipt; Nov. 26, 2006.
Declaration of Ann Mason; May 19, 2007.
Yummie Tummie and Maidenform Settle Patent Infringement and Invalidity Lawsuits, Fox News 44, PR Newswire (2011). http://www.fox44now.com/story/15242333/yummie-tummie-and-maidenform-settle-patent-infringement-and-invalidity-lawsuits?clienttype=printable—printed Aug. 12, 2011.
Maidenform Brands, Inc. Reports Second Quarter 2011 Results and Provides Guidance for Full Year 2011, News Releases—General News, Iselin, NJ—/PRNewswire via COMTEX/ Aug. 10, 2011.
Associated Press, "Maidenform 2Q net income drops on settlement," Yahoo News (Aug. 10, 2011). http:// news.yahoo.com/maidenform-2q-net-income-drops-settlement-125621767.html—printed Apr. 20, 2012.
Associated Press, "Maidenform 2Q net income drops on settlement," Yahoo News (Aug. 10, 2011). http://news.yahoo.com/maidenform-2q-net-income-drops-settlement-125621767.html—printed Apr. 20, 2012.
Cover and ad page picturing Serena Williams, "Lucky" magazine, Oct. 2003. (2 pages).
Mila Kunis Magazine Cover, [on-line]; [downloaded from the internet on May 5, 2012]; [cover identified is for Oct. 2003 issue]; URL: <http://www.whosdatedwho.com/tpx_1783/mila-kunis/magazinecovers_13>.
Left-hand image on Contents page, "Self" magazine, Jan. 2006 issue. (2 pages).
Email from Christine Conforte to Heather Schindler "FW: Tummy Tee," sent Dec. 1, 2006.
Email from Christine Conforte to Heather Schindler "Liz Lange," sent Dec. 13, 2006.
Email from Heather Schindler to Chistine Conforte "Liz Lange," sent Dec. 13, 2006.
Email from Christine Conforte "Liz Lange," sent Dec. 11, 2006.
Email from Heather Schindler to Christine Conforte "Liz Lange," sent Dec. 9, 2006.
Email from Christine Conforte to Heather Schindler "Liz Lange," sent Dec. 7, 2006.
Email from Heather Schindler to Christine Conforte "Liz Lange," sent Dec. 7, 2006.
Email from Christine Conforte to Heather Schindler, "Liz Lange," sent Dec. 6, 2006.
Email from Heather Schindler to Liz Lange copying Michelle Mooring and Christine Conforte, "Follow Up," sent Jan. 24, 2007.
Email from Liz Lange to Heather Schindler copying Christine Conforte and Michelle Mooring, "Follow Up," sent Jan. 23, 2007.
Email from Heather Schindler to Liz Lange copying Christine Conforte and Michelle Mooring, "Follow Up," sent Jan. 23, 2007.
Email from Liz Lange to Heather Schindler copying Christine Conforte "Follow Up," sent Jan. 19, 2007.
Email from Heather Schindler to Christine Conforte copying Michelle Mooring "FW: TummyTube," sent Jan. 31, 2007.
Email from Christine Conforte to Heather Schindler copying Liz Lange "Tummy Tube," sent Jan. 30, 2011.
Email from Heather Schindler to Liz Lange copying Michelle Mooring and Christine Conforte "TummyTube," sent Feb. 6, 2007.
Email from Liz Lange to Heather Schindler and Christine Conforte "TummyTube," sent Feb. 2, 2007.
Email from Heather Schindler to Christine Conforte copying Liz Lange "TummyTube," sent Feb. 2, 2007.
Email from Christine Conforte to Heather Schindler copying Liz Lange "TummyTube," sent Jan. 30, 2007.
"Style Spy," Lucky Magazine, p. 26, Jan. 2002 issue.
LeCove swimwear catalog, p. 26 received by Applicant Aug. 24, 2010.
JC Penney maternity catalog, p. 165 received by Applicant Aug. 24, 2010.
WWD Intimates catalog, cover received by Applicant Aug. 24, 2010.
"Fashion Q & A," Shape Magazine, p. 68. Jan. 2008 issue.
Vogue Magazine, vol. 15, cover received by Applicant Aug. 24, 2010.
"Self Selects," Self Magazine, p. 162. Jun. 2000 issue.
"Do good while you shop," Lucky Magazine, p. 286. Oct. 2006 issue.
"Photo Finish," WWD Intimates catalog. 2006.
"Shapewear Report," In Style Magazine, pp. 338-346. Sep. 2007 issue.
Self Magazine advertisements. Jun. 2007 issue.
Self Magazine, p. 33. Dec. 2007 issue.
"My best stress bust is . . . ," Self Magazine, p. 200. Apr. 2002 issue.
Times Three Clothier, LLC Sales Order No. 1000, Sales Order Date Apr. 30, 2007.
Email from Ivan A. Saperstein to Heather Schindler copying Michelle Mooring and J. Schindler "Gatsby's" sent Jul. 20, 2007.
Email from Heather Schindler to Ivan A. Saperstein copying Michelle Mooring and J. Schindler "Gatsby's" Jul. 20, 2007.
Email from Ivan A. Saperstein to Michelle Mooring, Heather Schindler and J. Schindler "Gatsby's" Jul. 20, 2007.
Invoice billed and shipped to Seams Beutiful-Carolyn Weaver, Invoice # 00006138, Aug. 11, 2006.
Invoice billed and shipped to Seams Beutiful-Carolyn Weaver, Invoice # 00006155, Aug. 25, 2006.
Packing Slip to Seams Beautiful, Aug. 25, 2006.
*Maidenform* v. *Times Three Clothier LLC d/b/a Yummie Tummie*, Case No. 10-cv-1661 (GBD)—Skinny Cami Declarations. pp. 1-118 (submitted in 9 parts) received by Applicant Dec. 14, 2010.
Applicant's Specifications. pp. 1-3 (submitted in 1 part) dated May 24, 2007—Jun. 11, 2007.
Maidenform's Initial Disclosures—Jul. 9, 2010. pp. 1-13 (submitted in 1 part).
Maidenform's Responses and Objections to TTC's First Set of Interrogatories (Nos. 1-18)—Aug. 24, 2010. pp. 1-12 (submitted in 1 part).
Skinny Camisole Slimmer Corset Shaper Girdle, http://co103w.co1103.mail.live.com/mail/RteTrame_15.1.3059.0405.html?pf=pf (URL is incomplete). pp. 1-3 (submitted in 1 part) received by Applicant Aug. 24, 2010.
Applicant's Tummy Tees. pp. 1-3 (submitted in 3 parts). 6Ba is Applicant's Tummy Tee early prototype sewn in Feb./Mar. 2005. 6Bb and 6Bc are photos of Applicant's production sample first received May 30, 2007.
Gazelle Sleeveless Long Shirt, Adidas, www.shopadidas.com/product/index.jsp?productID=3847890&v2=y&cp=3748175.3 . . . (URL is incomplete) received by Applicant Aug. 24, 2010.
Super Soft Slimmer Tank, MyShape, www.myshape.com/shop/style/11906?ci_sku=11906&utm_source . . . (URL is incomplete) received by Applicant Aug. 24, 2010.
Ann Michell Spaghetti Strap Tank Top Style 982, Lauren Silva, www.laurensilva.com/Ann_Michell_Spaghetti_Strap_Camisole_Control_Shirt_p/an . . . (URL is incomplete) received by Applicant Aug. 24, 2010.
New Marilyn Monroe Smoothing Camisole 7762, ebay, www.cgi.ebay.com/NEW-MARILYN-MONROE-SMOOTHING-CAMISOLE-7762-28 . . . (URL is incomplete) received by Applicant Aug. 24, 2010.
Nancy Ganz the Belly Band Convertible Bodybriefer 3313, Her Room, www.herroom.com/Nancy-Ganz-3313-The-Belly-Band-Convertible-Bodyvriefer.sht . . . (URL is incomplete) received by Applicant Aug. 24, 2010.

(56) References Cited

OTHER PUBLICATIONS

Nike Seamless Airborne Women's Long Tank Top, Nike, http://store.nike.com/us/en_us/?1=shop,pdp,ctr-inline/cid-1/pid-282277/pgid-238467 received by Applicant Aug. 24, 2010.
Declaration of Leslie Slavich; US District Court, Northern District Georgia Atlanta Division; Case 1:13-cv-00710-WSD; Apr. 16, 2013.
C9 by Champion Performance Tank Top, Target ad in Self Magazine; Received by Applicant on Aug. 2, 2013.
Great Glam Venezia, http://web.archive.org/web/20060420023326/http:// www.greatglam.com/pd_venezia.cfm; Received by Applicant on Aug. 2, 2013.
Rago Camisole Shaper 804 http://web.archive.org/web/20061116162926/http://www.herroom.com/Rago-Camisole-Shaper,Rago01-804,4.html; Received by Applicant on Aug. 2, 2013.
Cosabella Talco Camisole; http://shop.cosabella.com/Cosabella%20Talco%20Cannisole.html; Received by Applicant on Aug. 2, 2013.
Hanro Cotton Active Carni with Built-in Shelf Bra; http://www.herroom.com/style-status.aspx?key=Han001-1216 &src=discontinued; Received by Applicant on Aug. 2, 2013.
Natori Underneath Body Doubles Lace Camisole 142001; http://www.magiclamp.pk/productView.php?ASIN=B000A6SRZO &cat1=1036682&cat2=1040660&cat3=14333511&cat4=&cat5=#; Received by Applicant on Aug. 2, 2013.
OnGossamer Gossamer Model Camisole 5407; http://www.herroom.com/style-status.aspx?key=Ong001-5407&src=discontinued; Received by Applicant on Aug. 2, 2013.
Eberjay "India" lace carni; http://www.shopbop.com/india-lace-camisole-eberjey/vp/v=1/845524441853684.htm; Received by Applicant on Aug. 2, 2013.
Rago Camisole Shaper 804; http://www.herroom.com/rago-804-camisole-shaper.shtml; Received by Applicant on Aug. 2, 2013.
Fleur't 368 Amber Long Lace Hem Tank; Received by Applicant on Aug. 2, 2013.
Delites Long Lace Hemmed Camisole 369; Received by Applicant on Aug. 2, 2013.
Fleur't 327 LuLu's Delites Bustier Camisole; http://www.herroom.com/search2.aspx?terms=Fleur%E2%80%99t+327+LuLu%E2%80%99s+Delites+Bustier+Camisole+&new=yes; Received by Applicant on Aug. 2, 2013.
Barely There Breathe Shaping Camisole 4214; http://www.herroom.com/search2.aspx?terms=Barely+There+Breathe+Shaping+Camisole+4214+&new=yes; Received by Applicant on Aug. 2, 2013.
Hanky Panky Signature Lace Color Play Camisole with knowledge of a designer of ordinary skill; Received by Applicant on Aug. 2, 2013.
Barely There Breathe Shaping Camisole 4214 with knowledge of a designer of ordinary skill; Received by Applicant on Aug. 2, 2013.
Cosabella Bodyshaper Underwire Cami; Received by Applicant on Aug. 2, 2013.

* cited by examiner

FIG. 15A
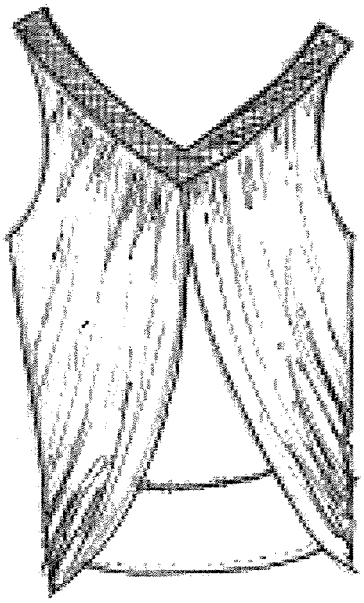
FIG. 15B
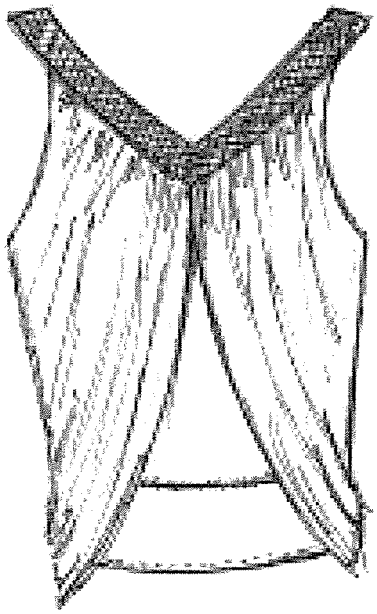
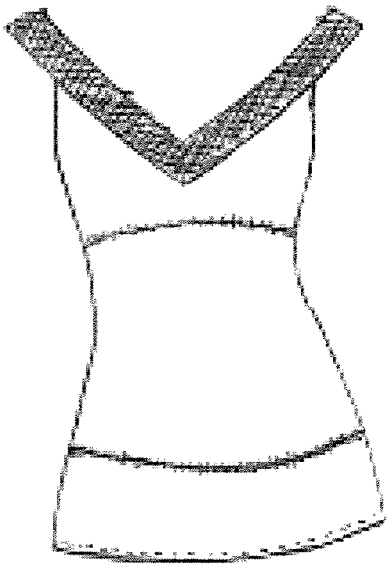
FIG. 15C
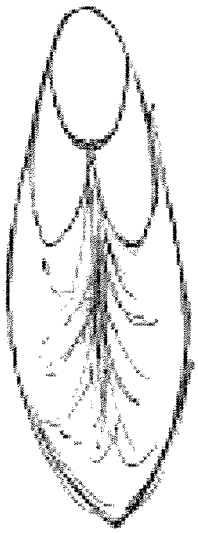
FIG. 15D

FIG. 18A
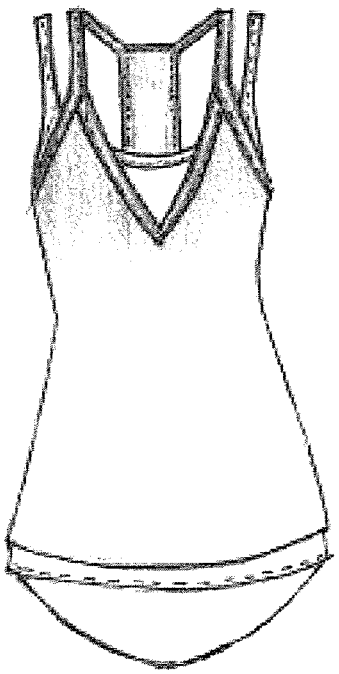
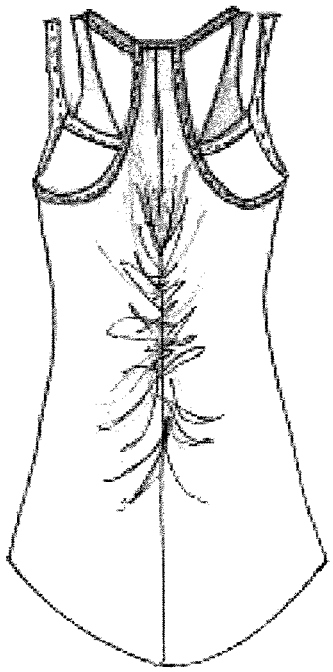
FIG. 18B
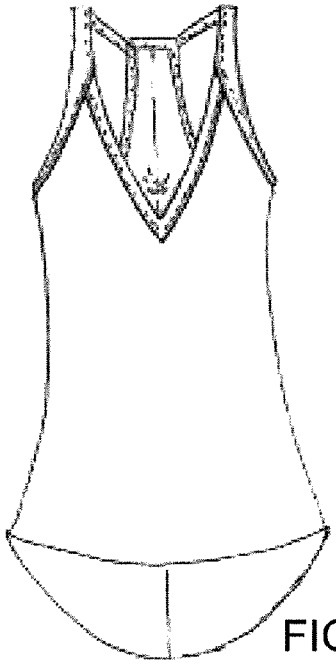
FIG. 18C
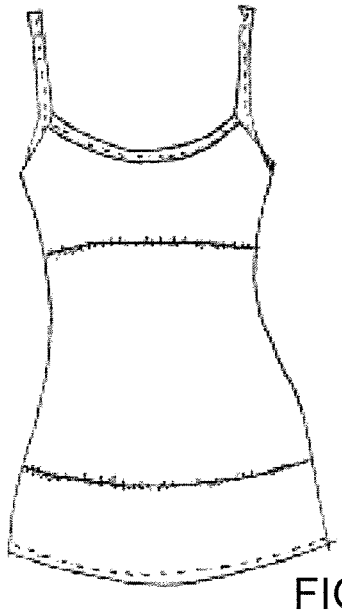
FIG. 18D

FIG. 20A
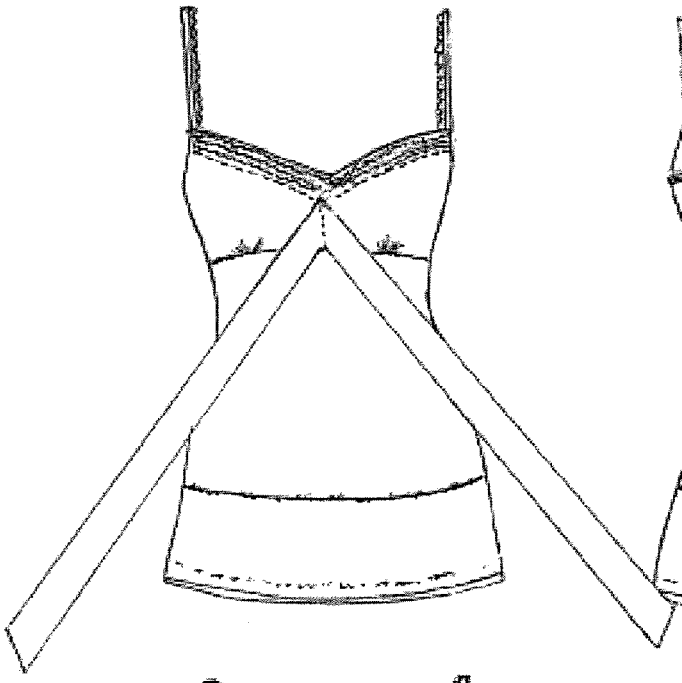
FIG. 20B
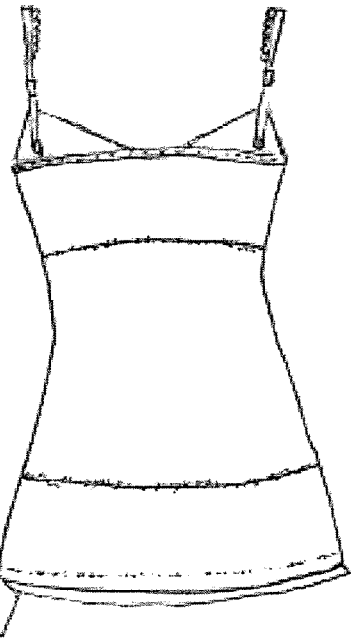
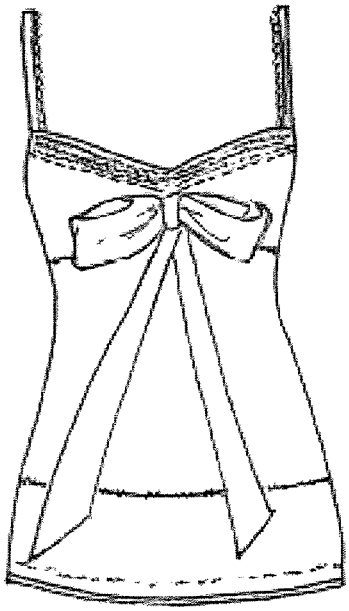
FIG. 20C

MULTI-FABRIC GARMENT

CROSS-REFERENCE TO RELATED APPLICATION

This application claims priority to provisional application Ser. No. 61/021,212, filed Jan. 15, 2008, which is incorporated herein by reference.

FIELD OF THE INVENTIONS

The present invention relates generally to multi-fabric garments. More specifically, the present invention relates to multi-fabric garments for slenderizing the midsection of a user.

BACKGROUND

Different garments provide different features for users, including aesthetic and functional features, some of which overlap. Functional features include covering certain portions of the wearer's body and providing support for certain other body portions. Aesthetic features include the overall image presented when a person wears a particular garment, as well as a change in the outward appearance of certain portions of a wearer's body due to wearing the garment.

Garments known in the art have incorporated compressive materials in order to more firmly support areas of a wearer's body than traditional materials, to give the appearance of a more slender figure. Some such garments are made exclusively of compressive materials. Others combine compressive materials with traditional noncompressive materials to balance the aesthetic and functional features of the garments.

For example, Japan Patent Laid-open Application JP 2006-316359, incorporated herein by reference, describes a sleeveless underwear garment that is a sort of undershirt one can put on downward from the head, which has a length enough to cover from shoulders to the vicinity of the crotch portion, and fits the body so as not to have an effect on the surface of the outer clothes. The sleeveless underwear consists on the front main body part and rear main body part, which are cylindrically formed together by round-braid knitting. A part of the sleeveless underwear includes different knitting organization to have the different tightening forces to corresponding parts. Specifically, in the vicinity of the waistline, a rib stitch provides a great straining force. The area with prescribed upper and lower width along the upper edge and lower edge of the support area has a cushioning area, which is formed by the different types of rib stitch to have a weaker straining force than the support area.

In addition, U.S. published application 2008-0134409, incorporated herein by reference, describes a shirt for supporting and shaping the mid-section of a wearer. The mid-section of the shirt includes an upper and lower region each constructed having a plurality of fabric densities or integrated elasticity portions. These elasticity portions provide support for the abdominal region, back, and back-side regions of the wearer where "love handles" sometime develop. The top-section of the shirt has a substantially loose fitting construction to yield a simple, clean and comfortable fit that facilitates breath-ability and comfort to the wearer. The shirt may be worn as an undershirt or as outerwear to minimize the wearer's torso. In another embodiment, the shirt further comprises an outer portion that extends over and covers the mid-section so that the mid-section acts as an internal support structure when the shirt is worn as a T-shirt or outerwear.

Notwithstanding the prior art support undergarments, there remains a need in the art for a women's garment adapted to support and shape the mid-section of a woman that is comfortable to wear and easy to position and/or maintain the position correctly. In addition, there is a need in the art for a woman's garment that shapes the mid-section of a woman in a comfortable manner.

SUMMARY

The inventions described here relate to multi-fabric garments for slenderizing the midsection of a user. In one aspect, the invention is a multi-fabric garment for slenderizing the midsection of a user, shaping the waistline of the user, and minimizing the roll up of the garment over the abdomen area of the user, comprising an upper section including a first non-compressive material, a slenderizing middle section including a compressive material, where the compressive material slenderizes the midsection of the user and shapes the waistline of the user, and a lower section including a second non-compressive material, where the lower section minimizes the roll up of the garment over the abdomen area of the user. Advantageously, the present invention includes lower section that also conceals additional abdominal and/or buttocks areas and can also serve to re-position the garment on the wearer/user. In addition, while one embodiment of the invention is focused on a women's multi-fabric garment, alternative embodiments of the multi-fabric garment may be used for men.

In some embodiments, the invention includes a compressive material in a front portion of the garment and a noncompressive material in a back portion of the garment. In some embodiments, the lower section of the garment is designed to alternatively be exposed for viewing or to be tucked into other clothes so as to not be exposed for viewing. In some embodiments, the invention is in the form of a women's tank top garment, including in some embodiments a halter top and/or racer back. In some embodiments, the compressive material substantially fully encompasses the abdominal area of a wearer.

BRIEF DESCRIPTION OF THE DRAWINGS

FIGS. 15A-15D illustrate a multi-fabric garment according to a fly-away embodiment of the invention.

FIGS. 18A-18D illustrate a multi-fabric multi-layer garment according to an embodiment of the invention.

FIGS. 20A-20C illustrate a multi-fabric garment with a bow according to an embodiment of the invention.

DETAILED DESCRIPTION

Figure 1:
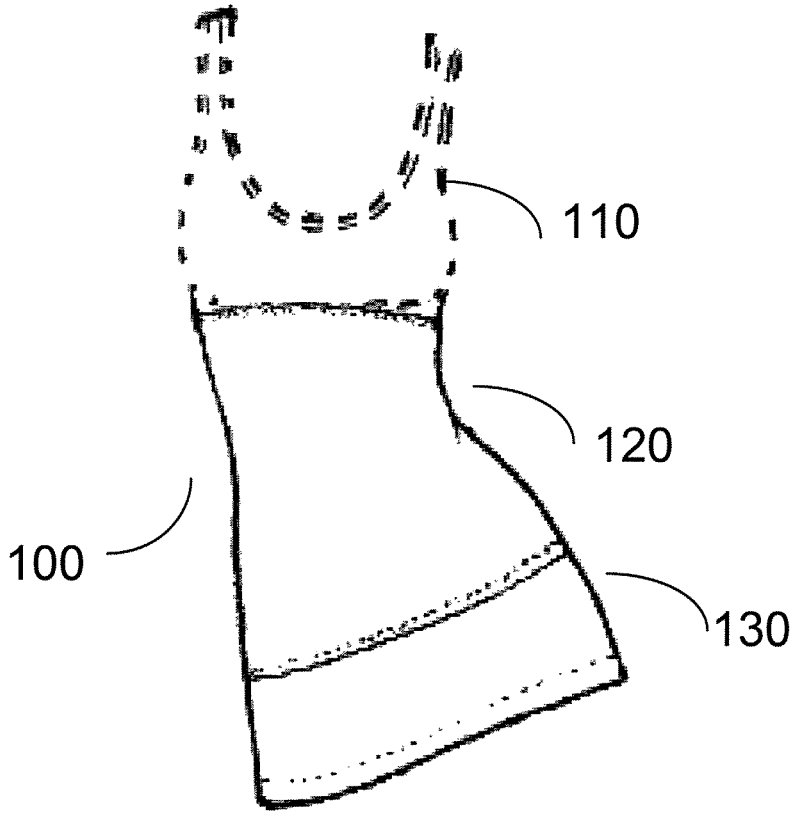
FIG. 1 illustrates a multi-fabric tank top garment according to one aspect of the invention.

The following description includes many specific details. The inclusion of such details is for the purpose of illustration only and should not be understood to limit the invention. Moreover, certain features which are well known in the art are not described in detail in order to avoid complication of the subject matter of the present invention. In addition, it will be understood that features in one embodiment may be combined with features in other embodiments of the invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

In some embodiments, the present invention encompasses a dual and/or multiple fabric garment as described herein. Specifically, the present invention comprises multi-fabric garments including one or more of, for example, a body contouring shaper tank top, a body contouring shaper tank top with a built in shelf bra, a body contouring shaper tank top with adjustable straps, a body contouring shaper short sleeve tee shirt, a body contouring shaper long sleeve tee shirt, a body contouring shaper tube top for the midsection, and/or a body contouring shaper boy short for the belly and buttocks without a top and/or pullover top. In some embodiments, the present invention comprises a multi-fabric garment with a racer back top, backless top or slip dress configuration with an extended lower section of non-compressive material such as cotton and/or lace.

In some embodiments, the multi-fabric garment of the present invention comprises different lengths, and/or different section sizes used in the garment. For example, the multi-fabric garment comprises v-neck and scoop neck configurations.

In some embodiments, the multi-fabric garment of the present invention is constructed to provide the following product details:

- Secret minimizing panel shapes entire waistline from the bust to the hips visibly taking off inches.
- Firm Control microfiber panel comfortably smoothes and naturally wicks moisture.
- Made with sleek yarns that do not cling.
- Exclusive dual fabric strategy provides a hip design and full coverage that stays in place.
- Extra long design does not roll up over the abdomen and is great for layering over or tucking into pants and skirts.
- Tag-less for added comfort.

Advantageously, the multi-fabric garment of the present invention slenderizes the mid section and camouflages visible lumps and bumps. The multi-fabric garment of the present invention minimizing panel shapes the entire waistline from the bust to the hips, visibly taking off inches form the waistline. The multi-fabric garment of the present invention uses in some embodiments firm control microfiber for the hidden panel to comfortably slenderize, smooth and/or naturally wick moisture. In some embodiments, the multi-fabric garment is made with sleek yarns that do not cling. The dual fabric strategy of other embodiments provides a hip design and full coverage that stays in place.

In some embodiments, the multi-fabric garment of the present invention is constructed to minimize the roll up over the belly or abdomen area of the body, and can be used for layering over or tucking into pants and skirts. In other embodiments, the multi-fabric garment of the present invention utilizes any generally compressive type fabric for the mid section, such as a micro denier, Spandex, also sometimes referred to as elastane, or other type of garment.

In some embodiments, the multi-fabric garment of the present invention includes one or more adjustable straps and/ or an inner shelf bra configuration. In some embodiments, the multi-fabric garment of the present invention advantageously includes a third lower section which is preferably comprised of cotton or other fabric that can be displayed or exposed for viewing. In some embodiments, the present invention is used not only to tuck into pants, but the longer design can be used as a layering garment. In addition, this third section of fabric or exclusive dual fabric design helps to keep the garment of the present invention in place. In fact, other body shapers roll up and do not stay put as well, whereas the three section or multi fabric design of embodiments of the present invention are functional to minimize or prevent roll up.

In some embodiments, the middle or shaper section of the multi-fabric garment of the present invention is shaped as a band like, and can take on a variety of shapes. In some embodiments, the multi-fabric garment of the present invention comprises a front only micro denier/spandex version that is connected to the back portion of the garment directly, for example, on the sides. In this embodiment, the back portion of the center section may be comprised of the same material as the top and lower portion, or may be comprised of other materials that generally are not used for compressive actions. In this embodiment, the multi fabric garment would perform differently from the full spandex version in that it would only slim and slenderize the abdomen or tummy area in the front. The back area of the body would not generally be slimmed in this embodiment, as the back would be of standard non-compressive type of material.

FIG. 1 illustrates a multi-fabric garment according to one aspect of the invention. Multi-fabric garment 100 includes upper section 110, slenderizing middle section 120, and lower section 130. Multi-fabric garment 100 can take many shapes, including long-sleeve, short-sleeve, sleeveless, tank top (including halter top), and many other shapes. The neckline of upper section 110 can also take many shapes, including scoop neck, crew neck, racer back, halter top and/or v-neck by way of nonlimiting examples.

Figure 2:
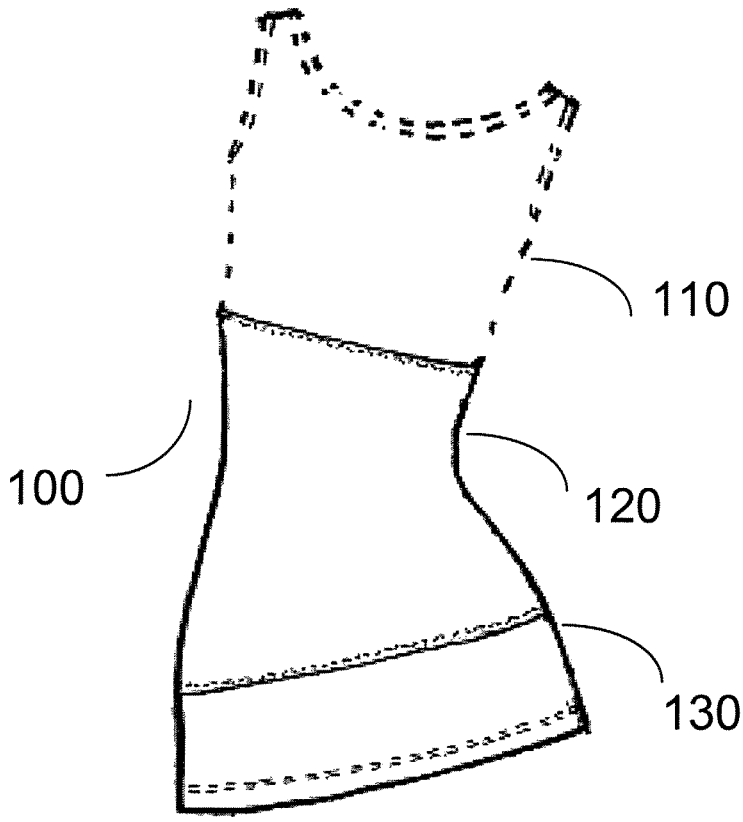
FIG. 2 illustrates a multi-fabric garment according an embodiment of the invention.

FIG. 2 illustrates a multi-fabric sleeveless garment according to an aspect of the invention. Multi-fabric garment 100 includes upper section 110, slenderizing middle section 120, and lower section 130.

Figure 3:
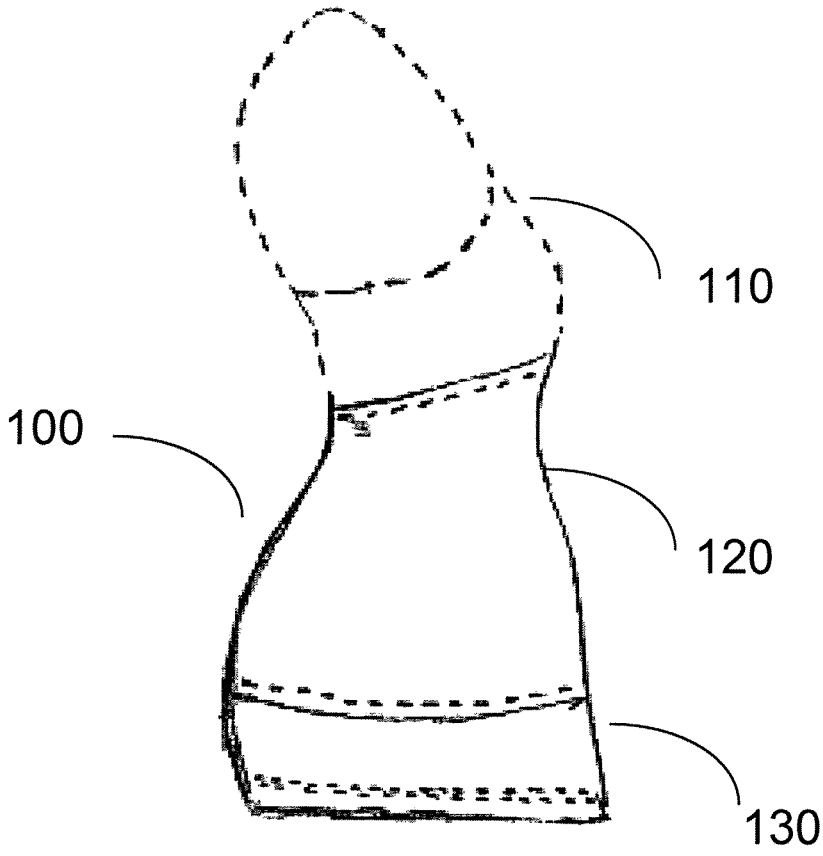
FIG. 3 illustrates a side view of a multi-fabric garment according an embodiment of the invention.
Figure 4:
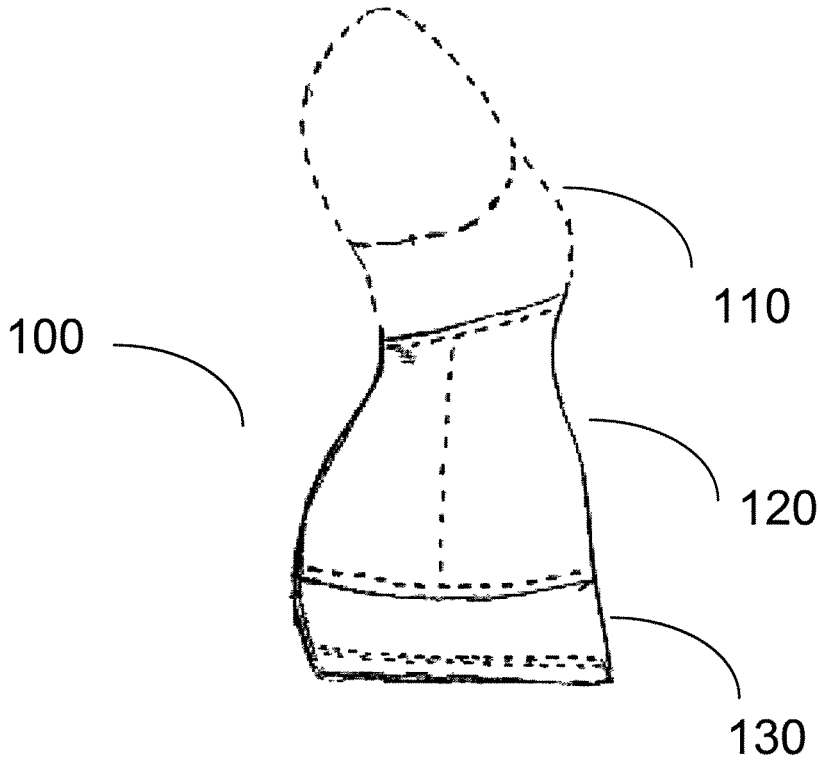
FIG. 4 illustrates a side view of a multi-fabric garment according another embodiment of the invention.

FIGS. 3 and 4 illustrate side views of multi-fabric garments according to aspects of the invention. Referring to both figures, multi-fabric garment 100 includes upper section 110, slenderizing middle section 120, and lower section 130.

Figure 5:
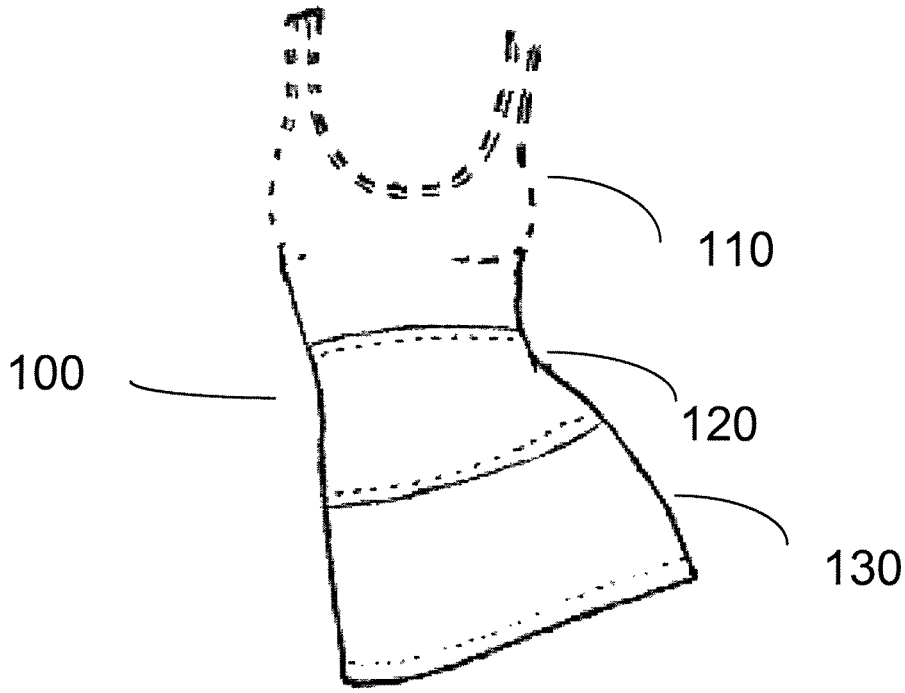
FIG. 5 illustrates a multi-fabric tank top garment according to an embodiment of the invention.
Figure 6:
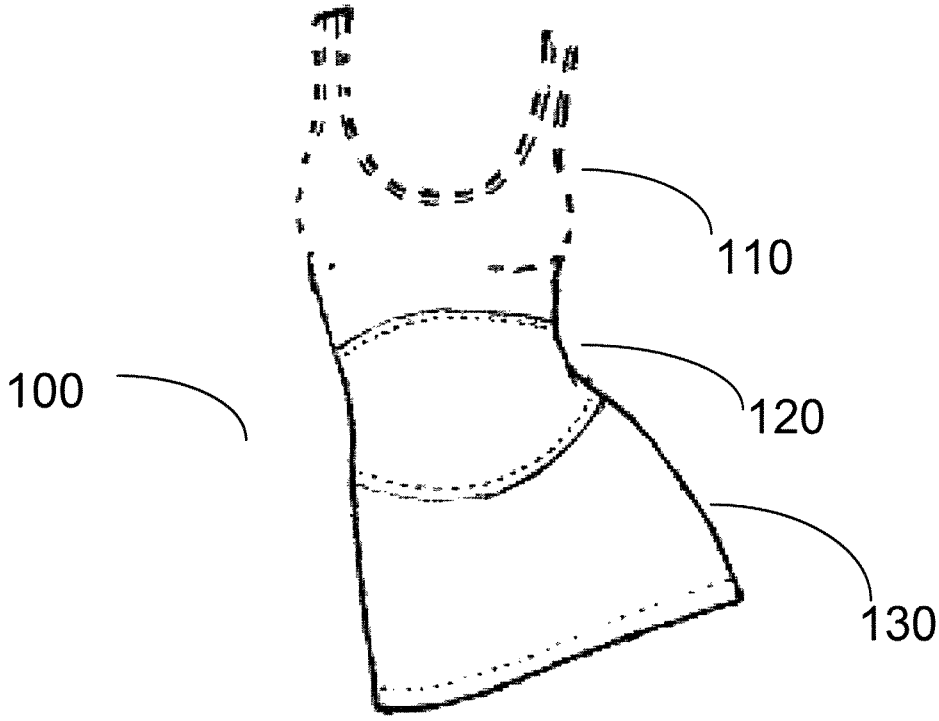
FIG. 6 illustrates a multi-fabric tank top garment according to another embodiment of the invention.
Figure 7:
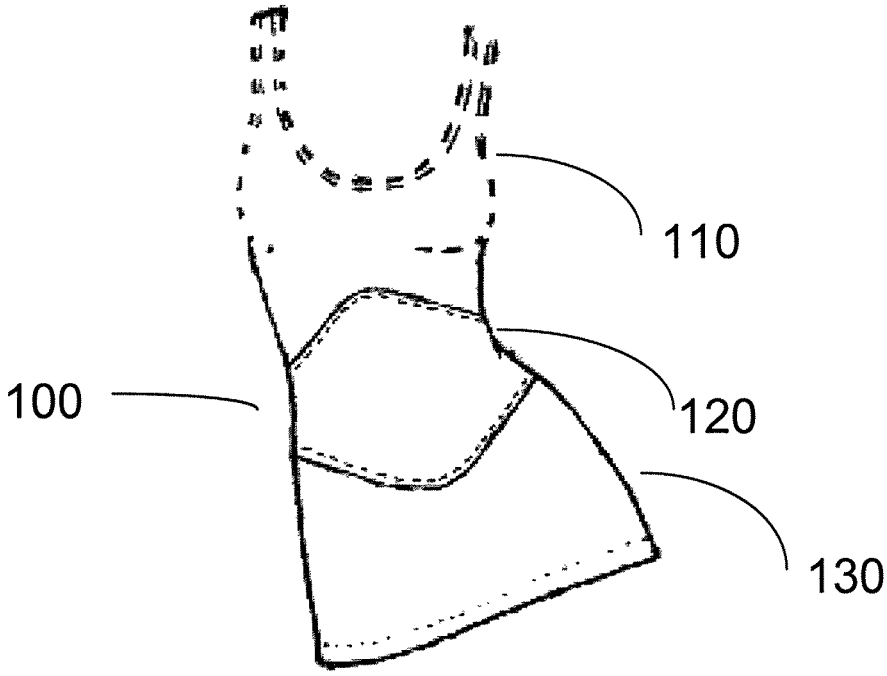
FIG. 7 illustrates a multi-fabric tank top garment according to yet another embodiment of the invention.
Figure 8:
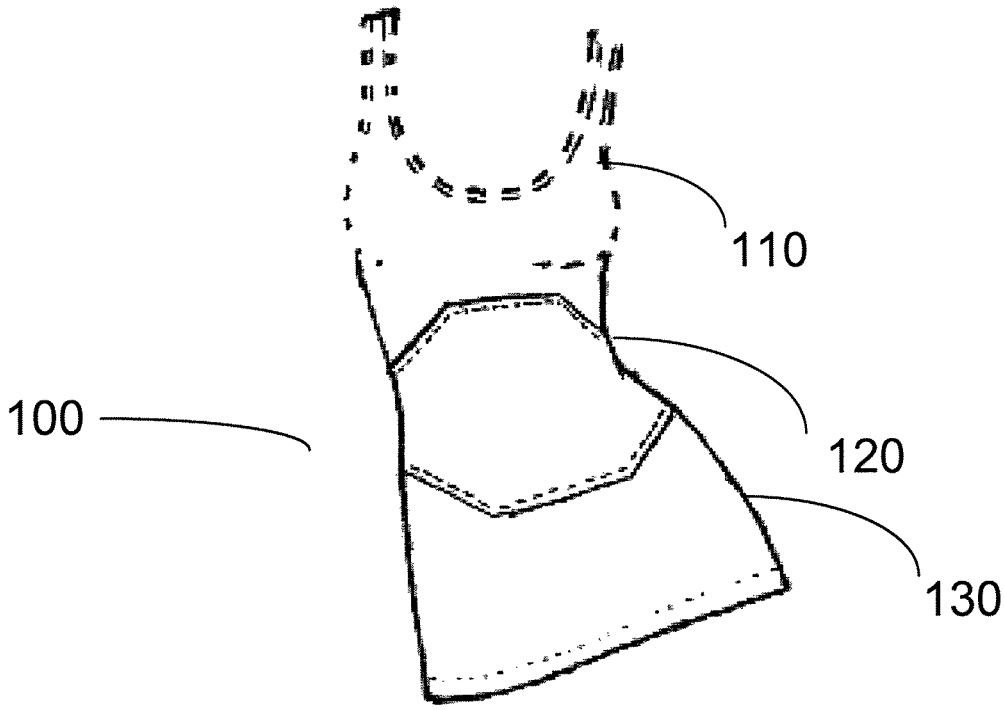
FIG. 8 illustrates a multi-fabric tank top garment according to another embodiment of the invention.

FIGS. 5 through 8 illustrate multi-fabric tank top garments according to aspects of the invention. Referring to FIGS. 5 through 8, multi-fabric garment 100 includes upper section 110, slenderizing middle section 120, and lower section 130. FIG. 5 illustrates slenderizing middle section 120 of nearly constant width around the multi-fabric garment. FIGS. 6 through 8 illustrate variable-width slenderizing middle sections 120. In each of FIGS. 6 though 8, the width of slenderizing middle section 120 is largest near a centerline of the body of the wearer, and smallest near the sides of the body of the wearer.

Figure 9:
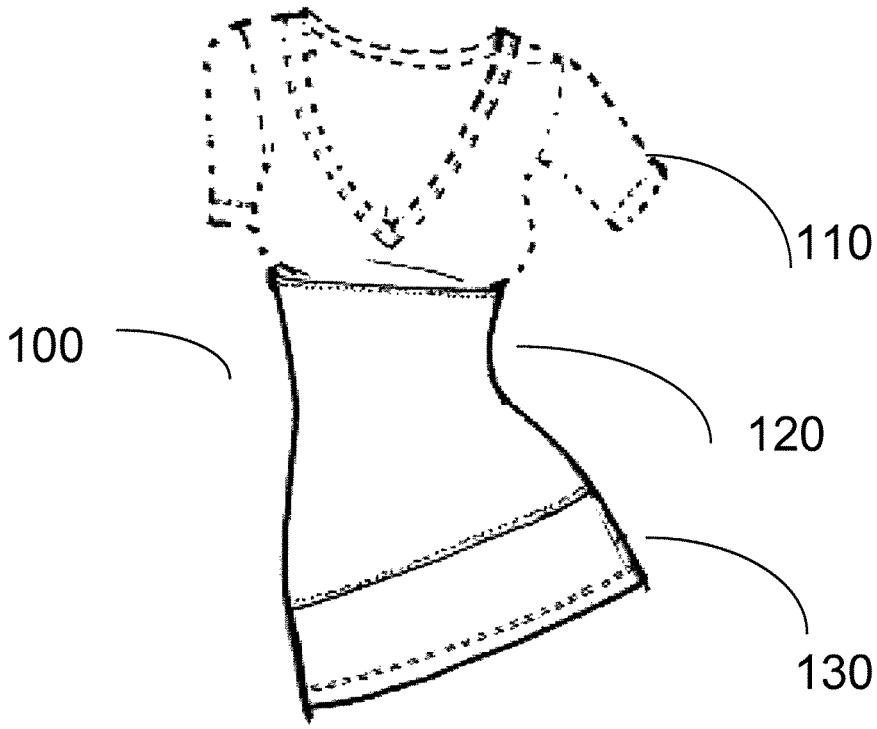
FIG. 9 illustrates a multi-fabric short-sleeved v-neck garment according to an embodiment of the invention.
Figure 10:
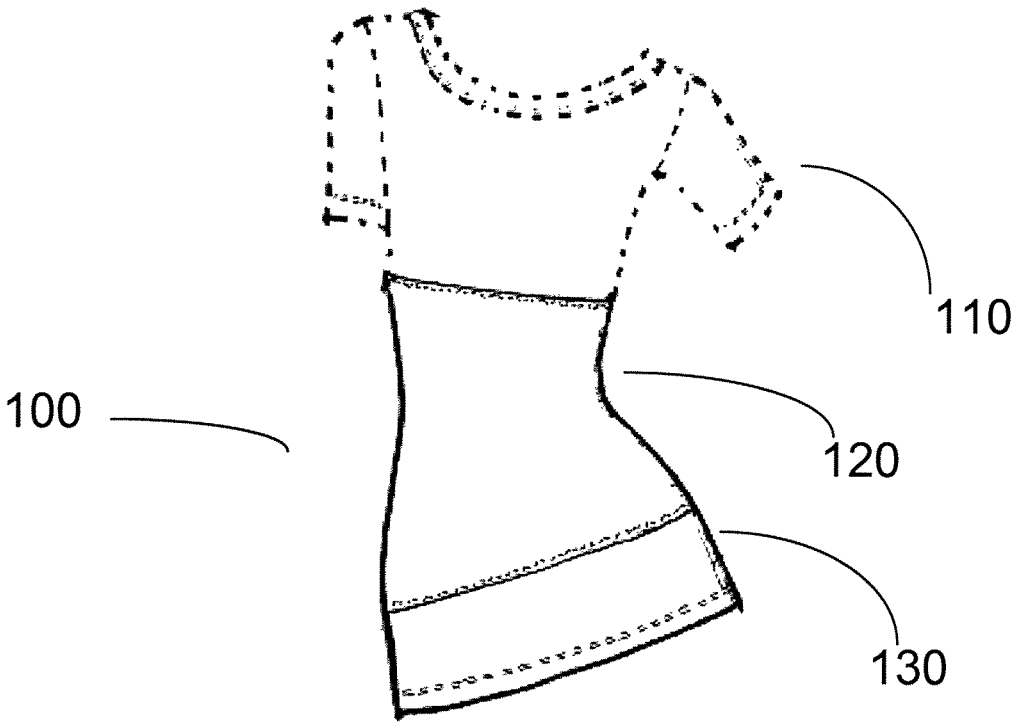
FIG. 10 illustrates a multi-fabric short-sleeved garment according to an embodiment of the invention.

FIGS. 9 and 10 illustrate multi-fabric short-sleeved garments according to aspects of the invention. Referring to both figures, multi-fabric garment 100 includes upper section 110, slenderizing middle section 120, and lower section 130. FIG. 9 illustrates a v-neck upper section 110, while FIG. 10 illustrates a higher neck upper section 110.

Figure 11:
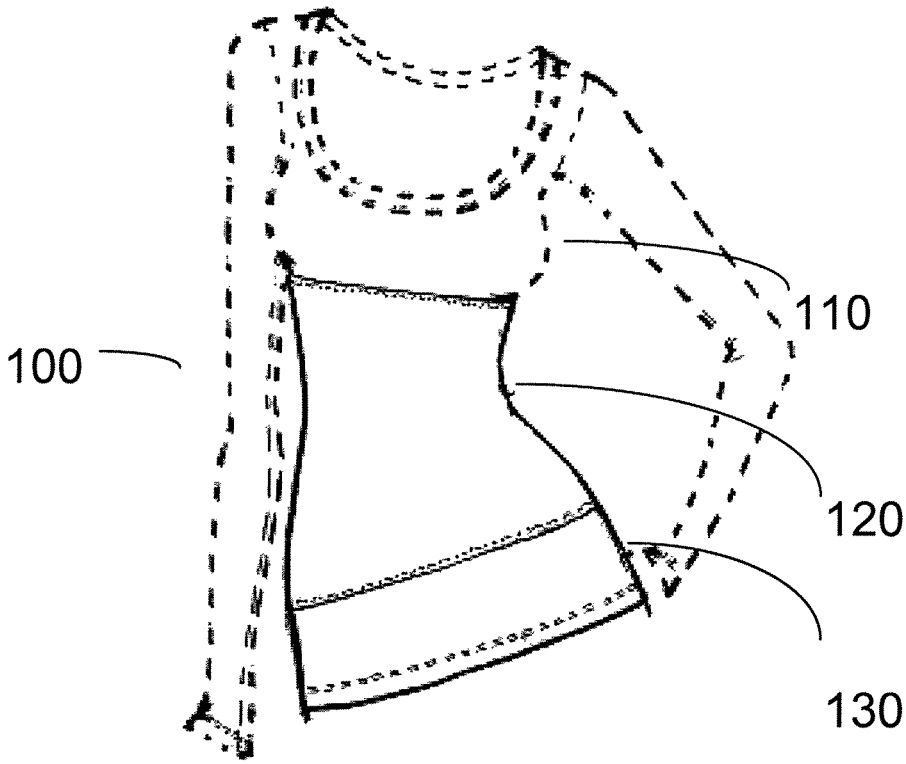
FIG. 11 illustrates a multi-fabric long-sleeved scoop neck garment according to an embodiment of the invention.
Figure 12:
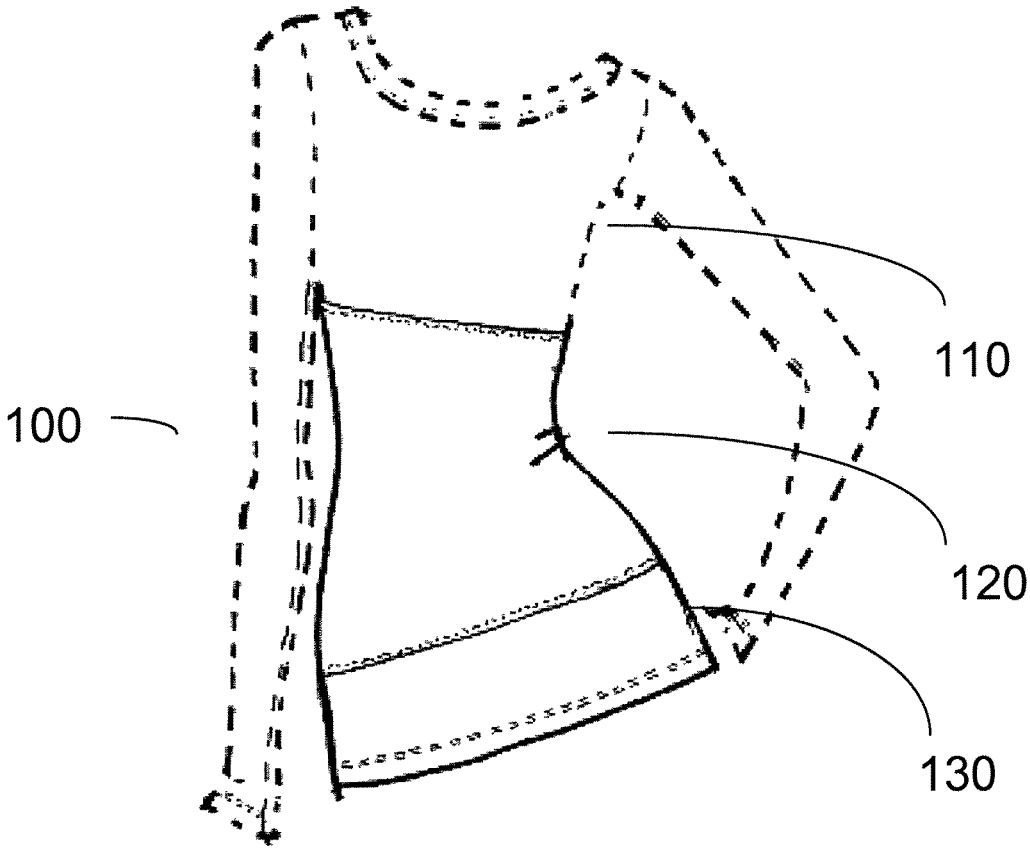
FIG. 12 illustrates a multi-fabric long-sleeved garment according to another embodiment of the invention.
Figure 13:
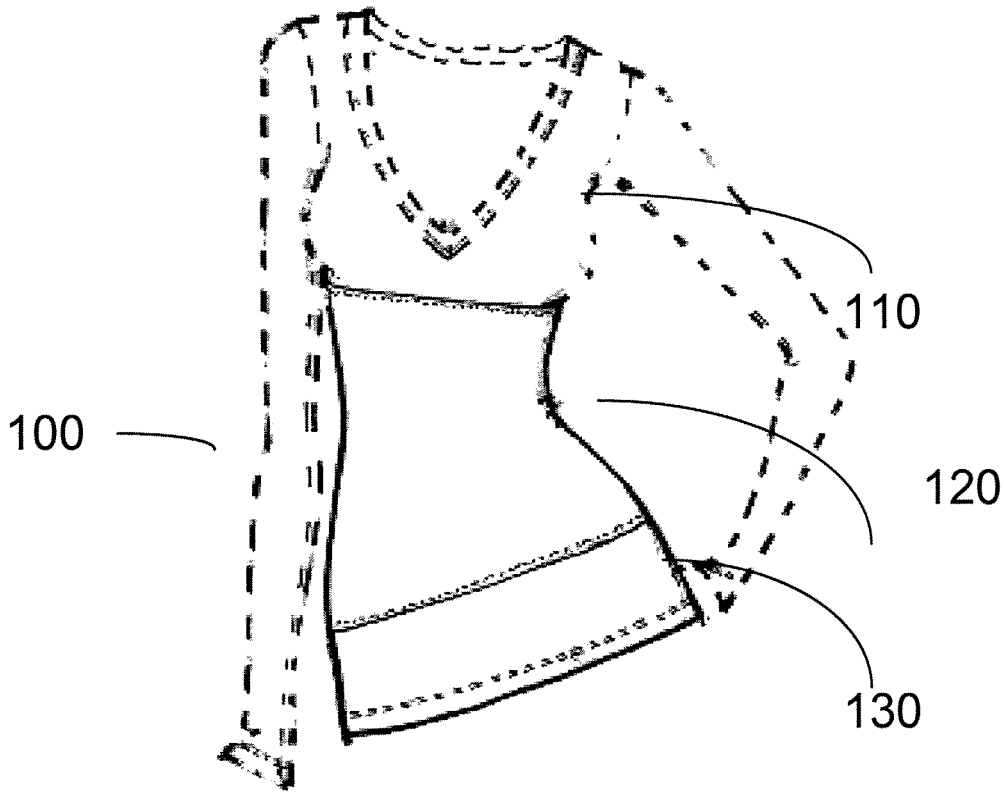
FIG. 13 illustrates a multi-fabric long-sleeved v-neck garment according to an embodiment of the invention.
Figure 14:
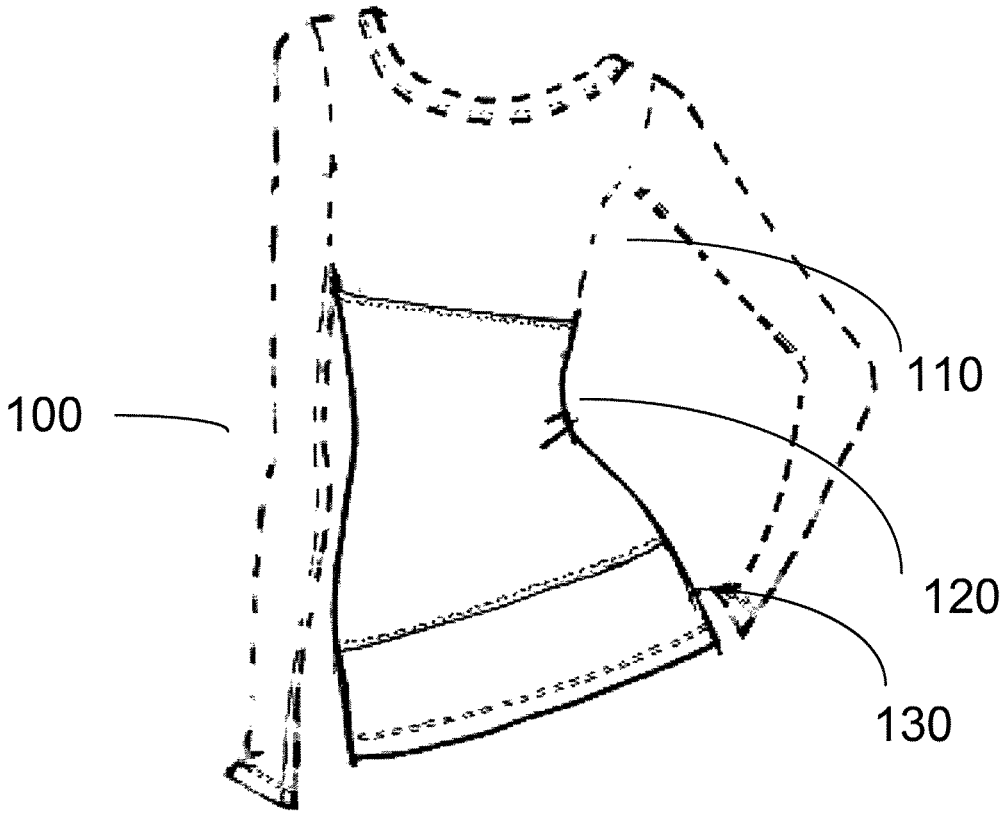
FIG. 14 illustrates a multi-fabric long-sleeved garment according to another embodiment of the invention.

FIGS. 11 through 14 illustrate multi-fabric long-sleeved garments according to aspects of the invention. Referring to FIGS. 11 through 14, multi-fabric garment 100 includes upper section 110, slenderizing middle section 120, and lower section 130. FIG. 11 illustrates a scoop neck multi-fabric long-sleeved garment. FIGS. 12 and 14 illustrate higher neck line multi-fabric long-sleeved garments. FIG. 13 illustrates a v-neck multi-fabric long-sleeved garment.

FIGS. 15A-15D illustrate a multi-fabric garment according to a fly-away embodiment of the invention. FIGS. 15A and B illustrate a rear view of the embodiment or alternatively a front view of the embodiment. FIG. 15C illustrates a front view of the embodiment or alternatively a rear view of the embodiment. FIG. 15D illustrates a side view of the embodiment. FIGS. 15A and 15B illustrate the fly-away portion of the embodiment at least partially covering the slenderizing middle section of the garment.

Figure 16A:
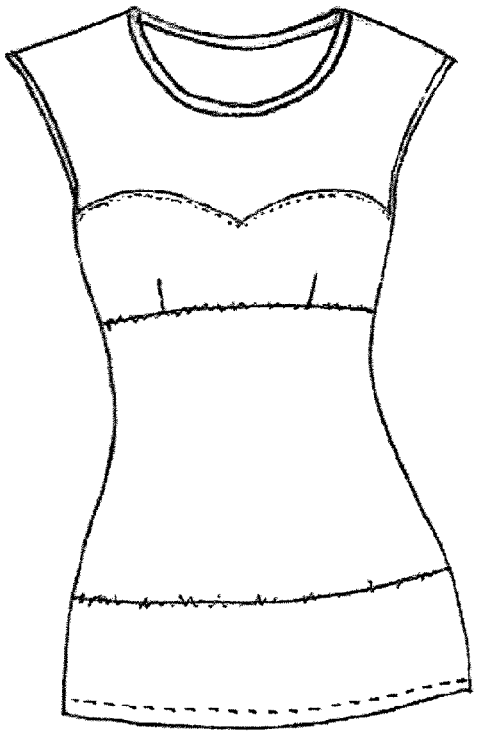
FIGS. 16A and 16B illustrate a multi-fabric sleeveless garment according to an embodiment of the invention.
Figure 16B:
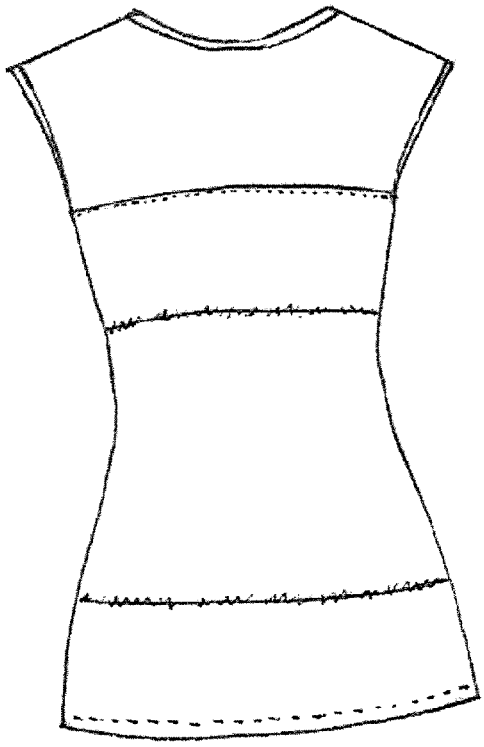

FIGS. 16A and 16B illustrate a multi-fabric sleeveless garment according to an embodiment of the invention. FIG. 16A illustrates a front view of this embodiment, while FIG. 16B illustrates a rear view of this embodiment.

Figure 17A:
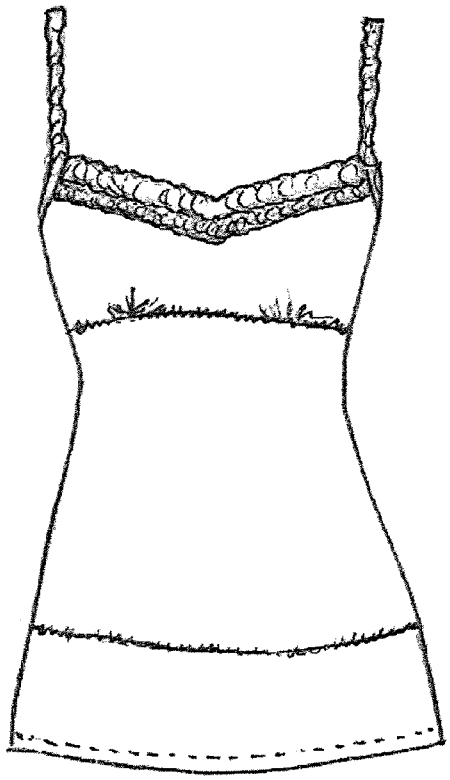
FIGS. 17A and 17B illustrate a multi-fabric garment according to an embodiment of the invention.
Figure 17B:
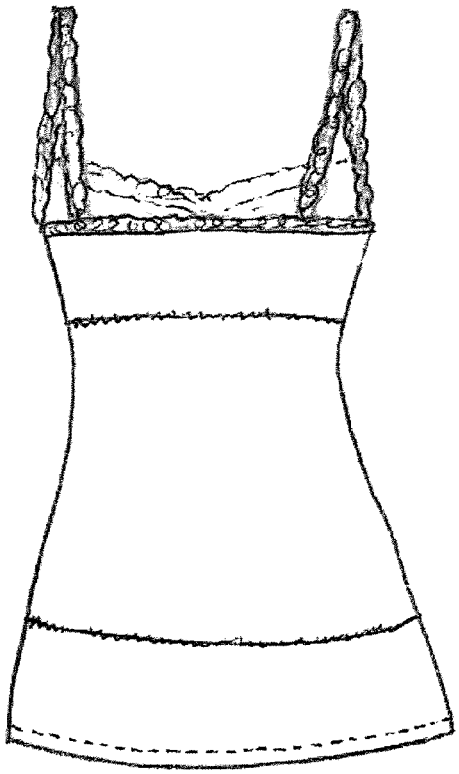

FIGS. 17A and 17B illustrate a multi-fabric garment according to an embodiment of the invention. FIG. 17A illustrates a front view of this embodiment, while FIG. 17B illustrates a rear view of this embodiment.

FIGS. 18A-18D illustrate a multi-fabric multi-layer garment according to an embodiment of the invention. FIG. 18D illustrates an inside layer of the garment according to this embodiment. FIG. 18C illustrates an outside layer of the garment. The inside layer, as illustrated in FIG. 18D, includes the slenderizing middle section as previously discussed. The outside layer, as illustrated in FIG. 18C, is worn outside of the inside layer. FIG. 18A illustrates a front view of both layers together, while FIG. 18B illustrates a rear view of both layers together.

Figure 19A:
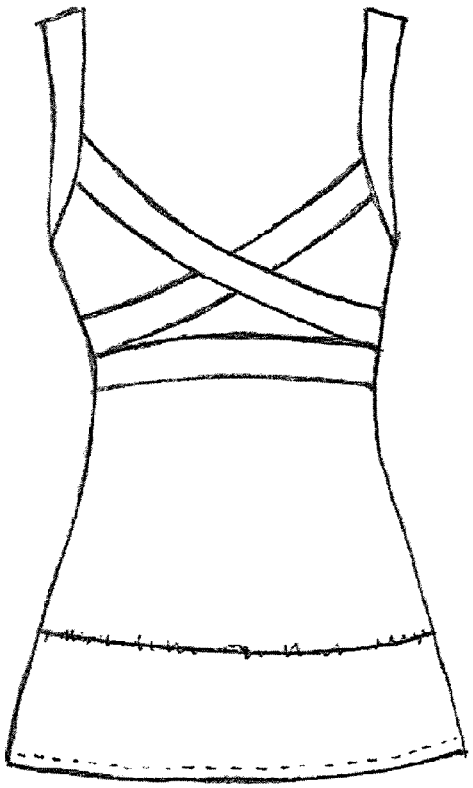
FIGS. 19 A and 19B illustrate a multi-fabric garment according to an embodiment of the invention.
Figure 19B:
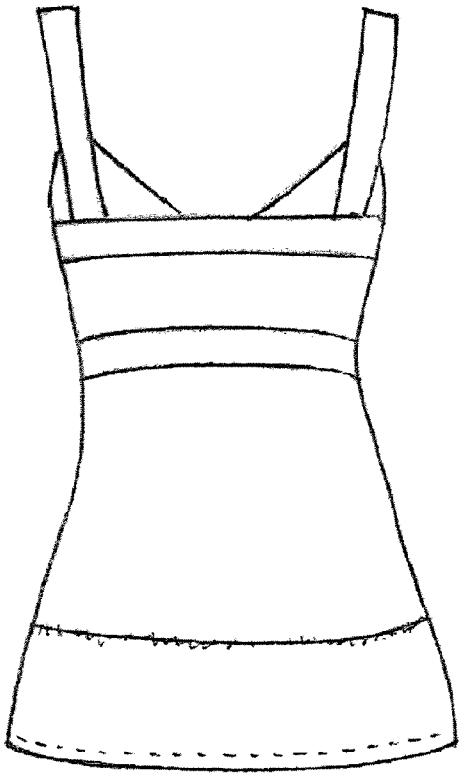

FIGS. 19A and 19B illustrate a multi-fabric garment according to an embodiment of the invention. FIG. 19A illustrates a front view of this embodiment, while FIG. 19B illustrates a rear view of this embodiment.

FIGS. 20A-20C Illustrate a multi-fabric garment with a bow according to an embodiment of the invention. FIG. 20A is a front view of this embodiment, showing an unconstructed bow. FIG. 20B is a rear view of this embodiment. FIG. 20C is a front view of this embodiment, showing a constructed bow.

Figure 21A:
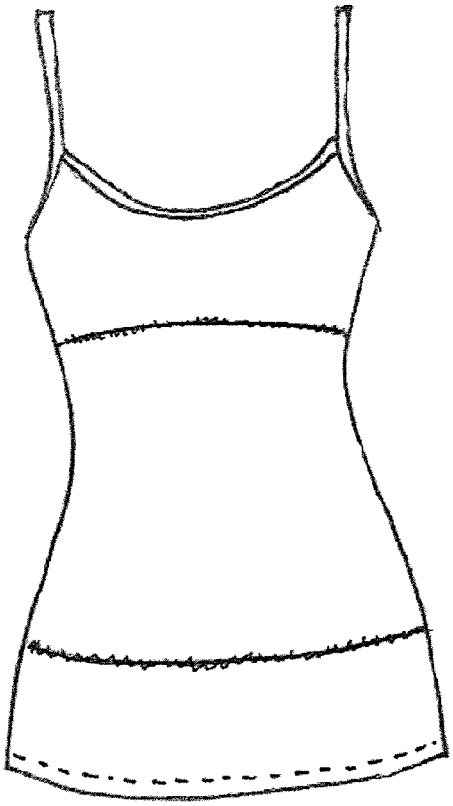
FIGS. 21A and 21B illustrate a multi-fabric lace strappy garment according to another embodiment of the invention.
Figure 21B:
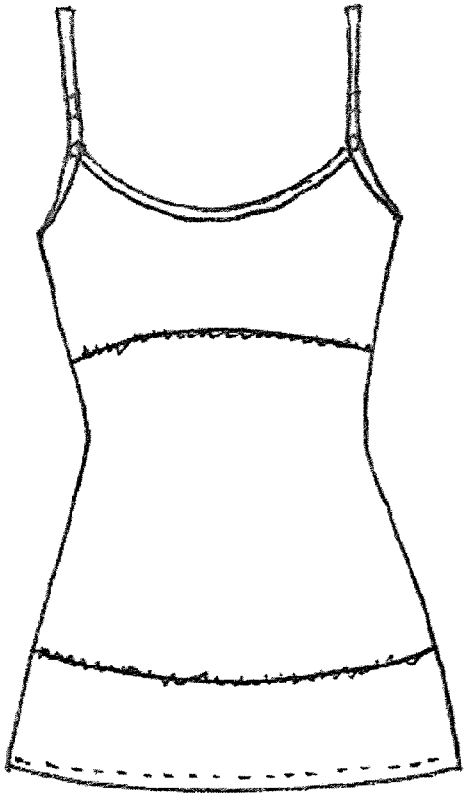

FIGS. 21A and 21B illustrate a multi-fabric lace strappy garment according to an embodiment of the invention.

Figure 22A:
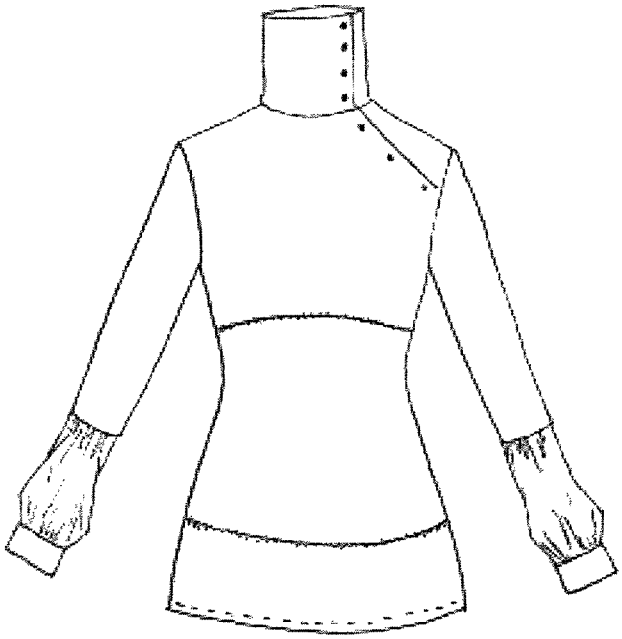
FIGS. 22A and 22B illustrate a multi-fabric turtleneck garment according to an embodiment of the invention.
Figure 22B:
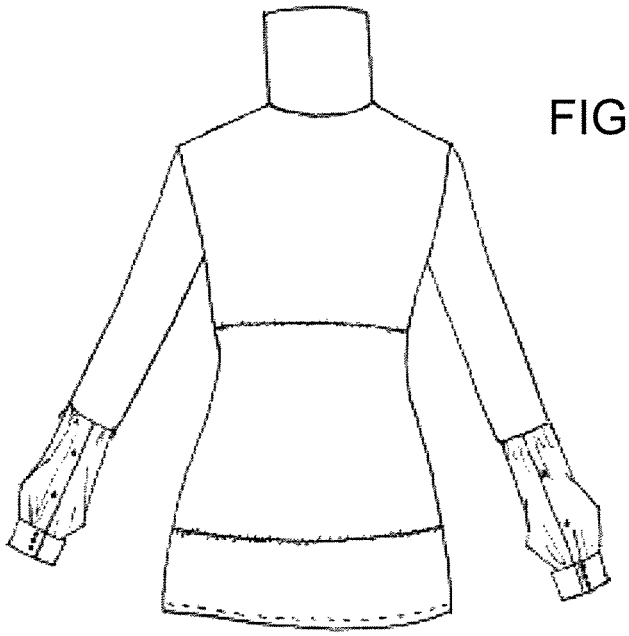

FIGS. 22A and 22B illustrate a multi-fabric turtleneck garment according to an embodiment of the invention. FIG. 22A illustrates a front view of this embodiment, while FIG. 22B illustrates a rear view of this embodiment.

Figure 23A:
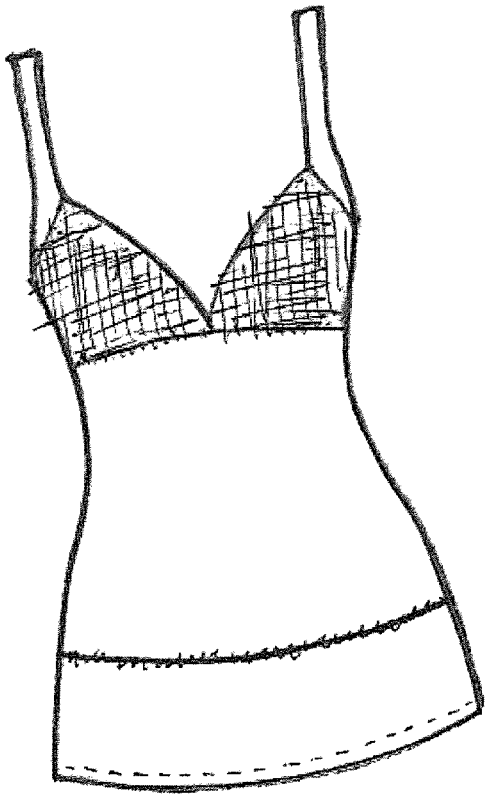
FIGS. 23A and 23B illustrate a multi-fabric rock 'n roll garment according to an embodiment of the invention.
Figure 23B:
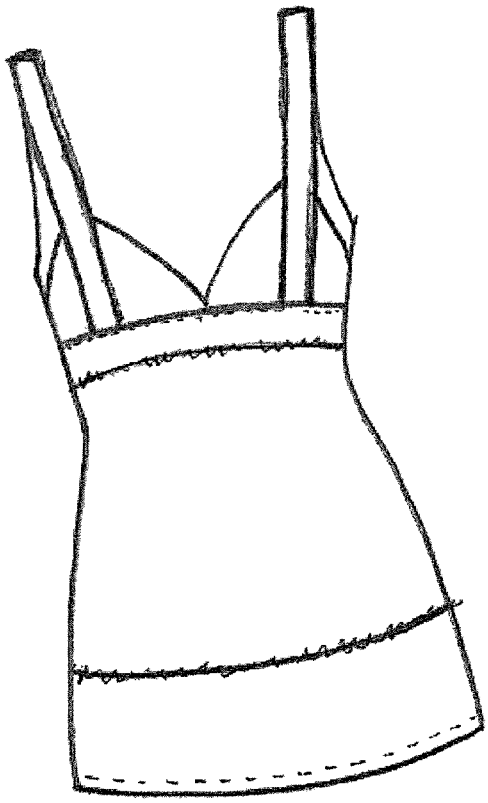

FIGS. 23A and 23B illustrate a multi-fabric rock 'n roll garment according to an embodiment of the invention. FIG. 23A illustrates a front view of this embodiment, while FIG. 23B illustrates a rear view of this embodiment.

Figure 24:
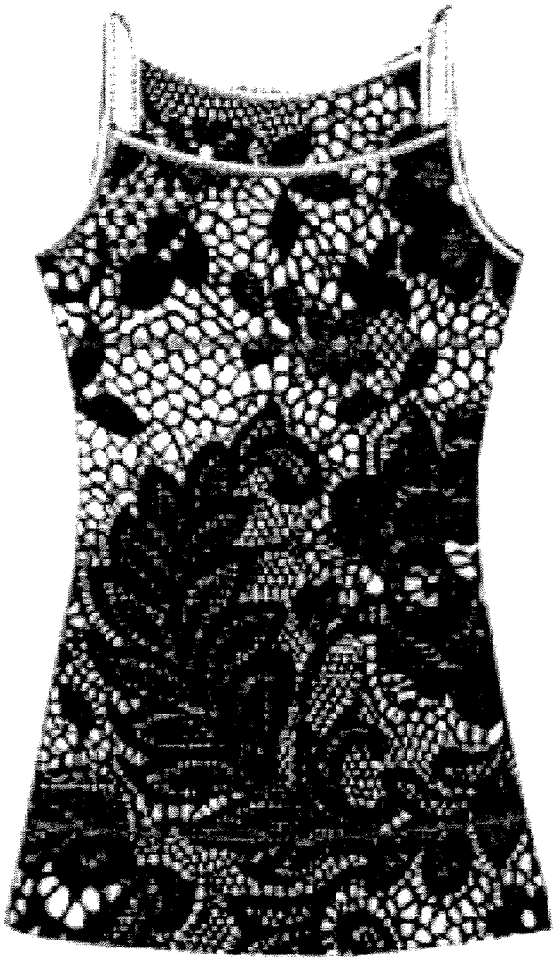
FIG. 24 illustrates a multi-fabric lace print strappy garment according to an embodiment of the invention.

FIG. 24 illustrates a multi-fabric lace print strappy garment according to an embodiment of the invention.

Figure 25:
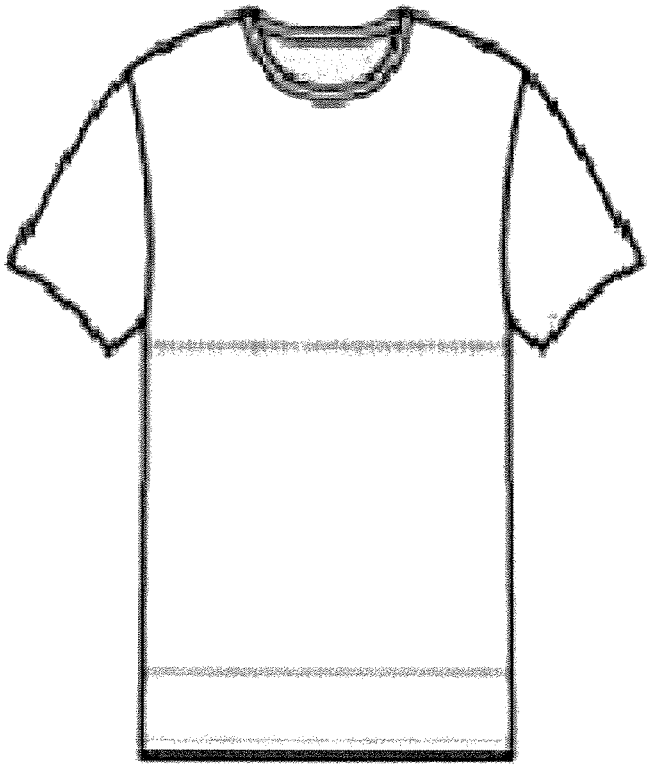
FIG. 25 illustrates a multi-fabric men's crew neck garment according to an embodiment of the invention.

FIG. 25 illustrates a multi-fabric men's crew neck garment according to an embodiment of the invention.

Figure 26:
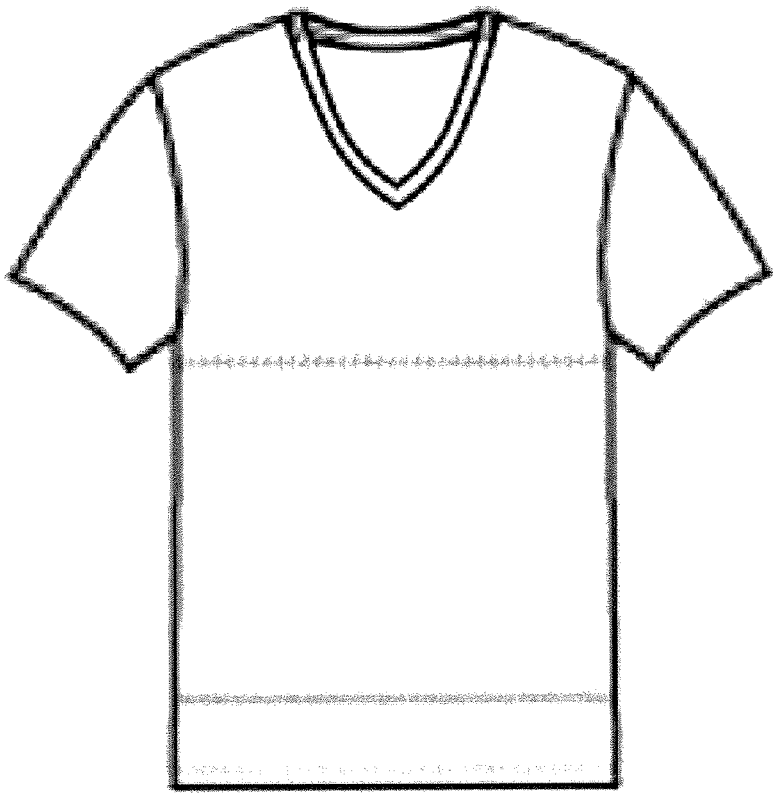
FIG. 26 illustrates a multi-fabric men's v-neck garment according to an embodiment of the invention.

FIG. 26 illustrates a multi-fabric men's v-neck garment according to an embodiment of the invention.

Figure 27:
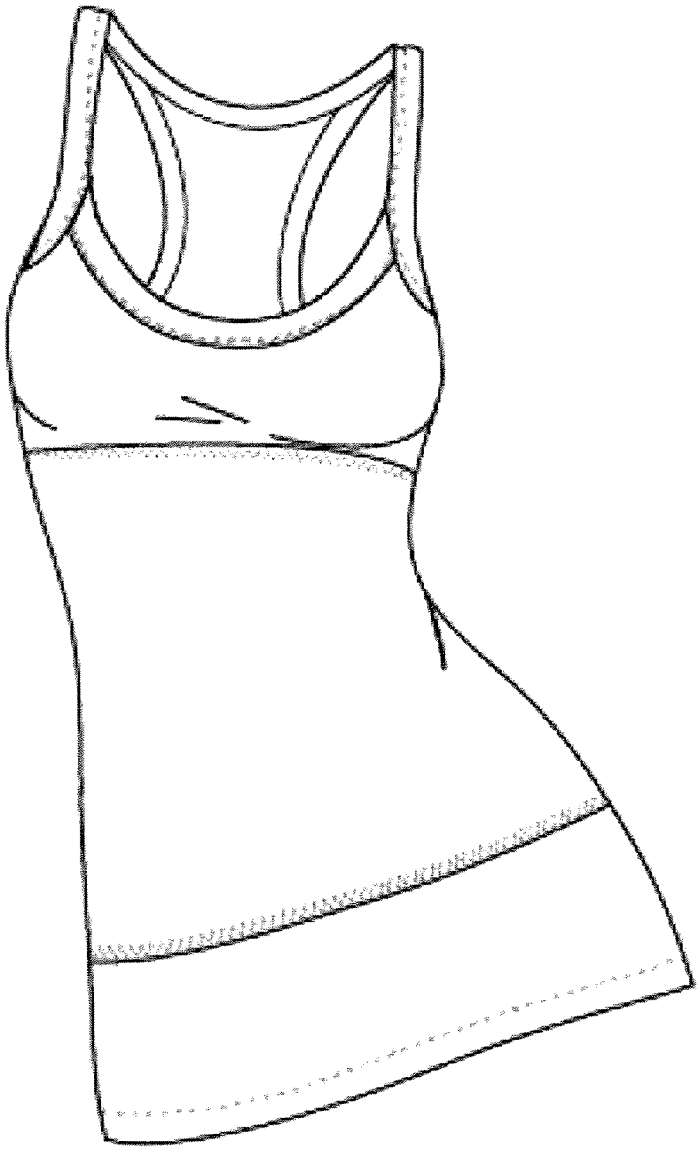
FIG. 27 illustrates a multi-fabric racerback tank garment according to an embodiment of the invention.

FIG. 27 illustrates a multi-fabric racerback tank garment according to an embodiment of the invention.

Figures 28A, 28B:
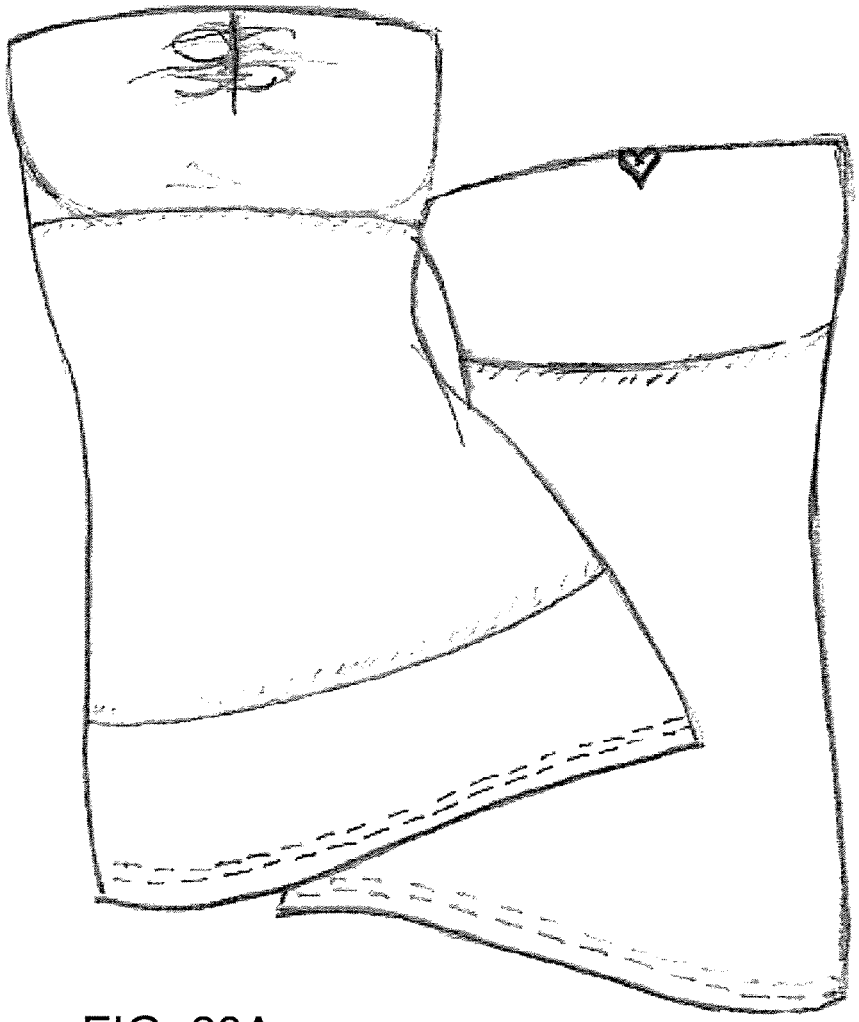
FIGS. 28A and 28B illustrate a multi-fabric tube top garment according to an embodiment of the invention.

FIGS. 28A and 28B illustrate a multi-fabric tube top garment according to an embodiment of the invention. FIG. 28A illustrates a front view of this embodiment, while FIG. 28B illustrates a rear view of this embodiment.

Figures 29A, 29B:
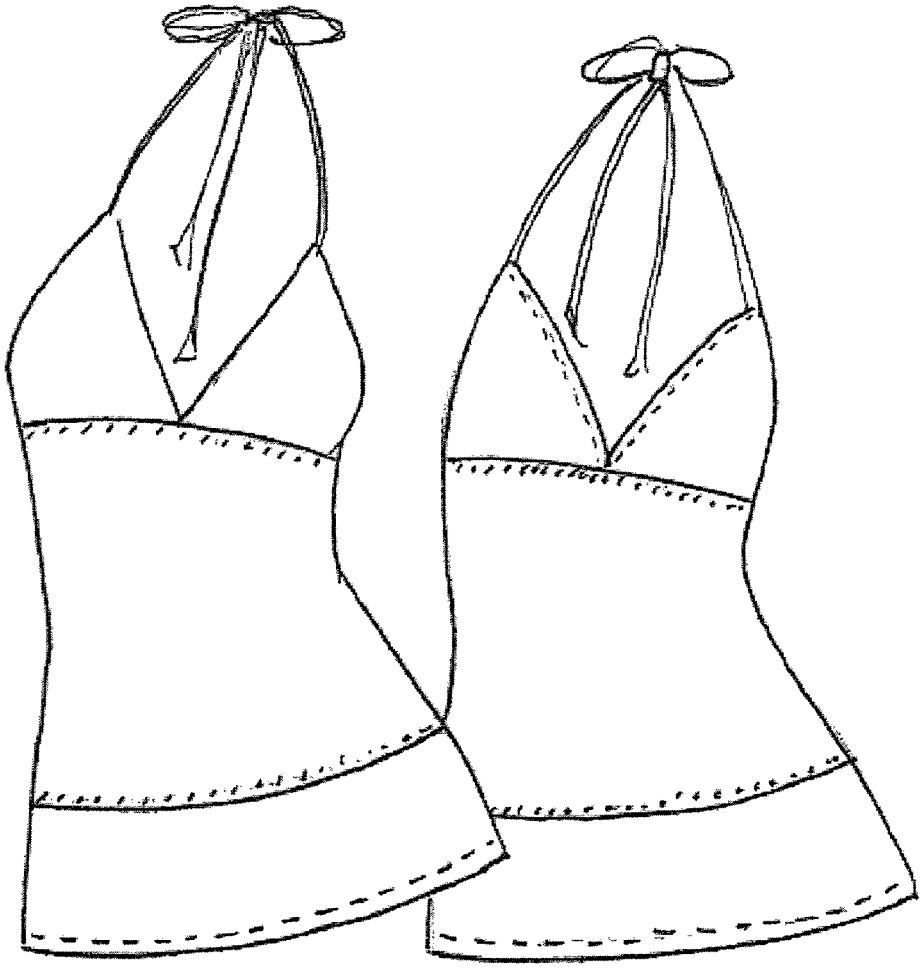
FIGS. 29A and 29B illustrate a multi-fabric garment according to an embodiment of the invention.

FIGS. 29A and 29B illustrate a multi-fabric garment according to an embodiment of the invention. FIG. 29A illustrates a front view of this embodiment, while FIG. 29B illustrates a rear view of this embodiment.

Figure 30A:
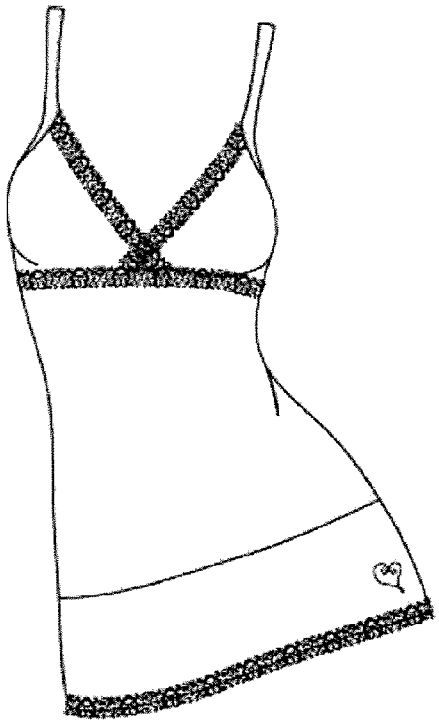
FIGS. 30A and 30B illustrate a multi-fabric lace tank garment according to an embodiment of the invention.
Figure 30B:
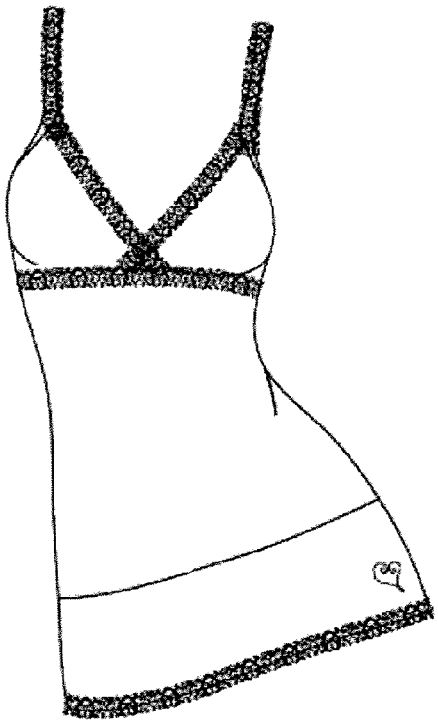

FIGS. 30A and 30B illustrate a multi-fabric lace tank garment according to an embodiment of the invention.

Figure 31:
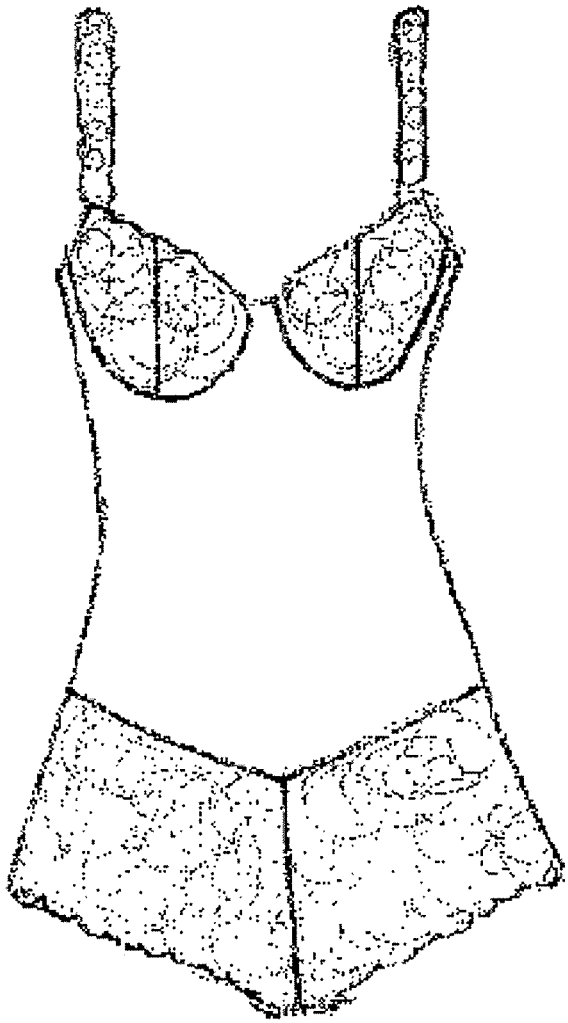
FIG. 31 illustrates a multi-fabric teddie garment according to an embodiment of the invention.

FIG. 31 illustrates a multi-fabric teddie garment according to an embodiment of the invention.

Figures 32A, 32B:
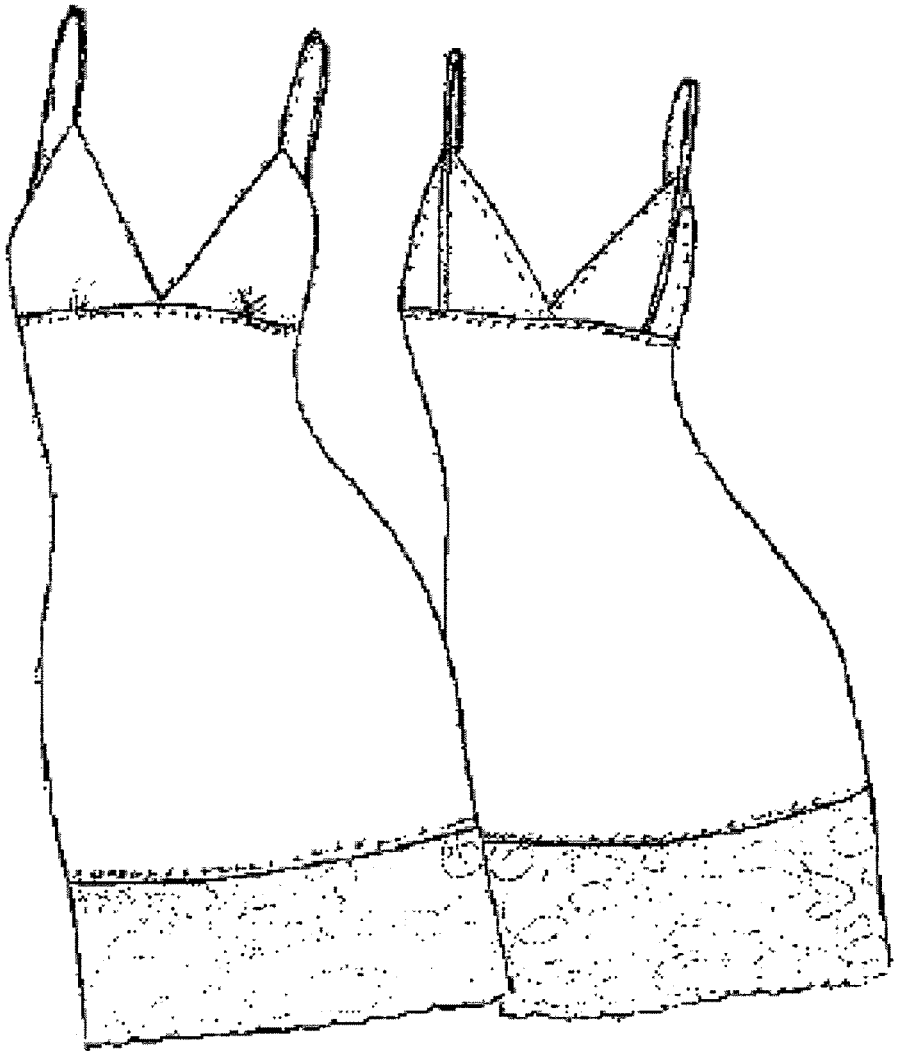
FIGS. 32A and 32B illustrate a multi-fabric halter slip garment according to an embodiment of the invention.

FIGS. 32A and 32B illustrate a multi-fabric halter slip garment according to an embodiment of the invention. FIG. 32A illustrates a front view of this embodiment, while FIG. 32B illustrates a rear view of this embodiment.

Figures 33A, 33B:
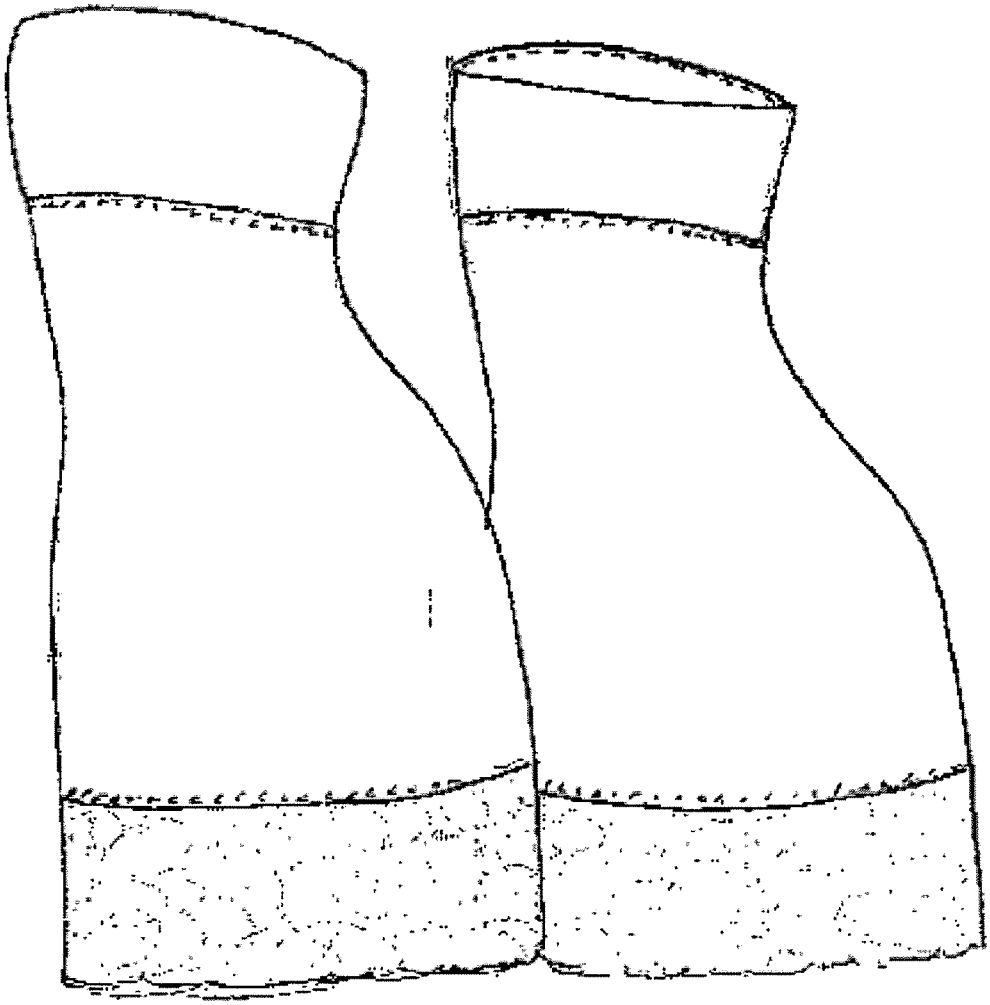
FIGS. 33A and 33B illustrate a multi-fabric strapless slip garment according to an embodiment of the invention.

FIGS. 33A and 33B illustrate a multi-fabric strapless slip garment according to an embodiment of the invention. FIG. 33A illustrates a front view of this embodiment, while FIG. 33B illustrates a rear view of this embodiment.

Figure 34:
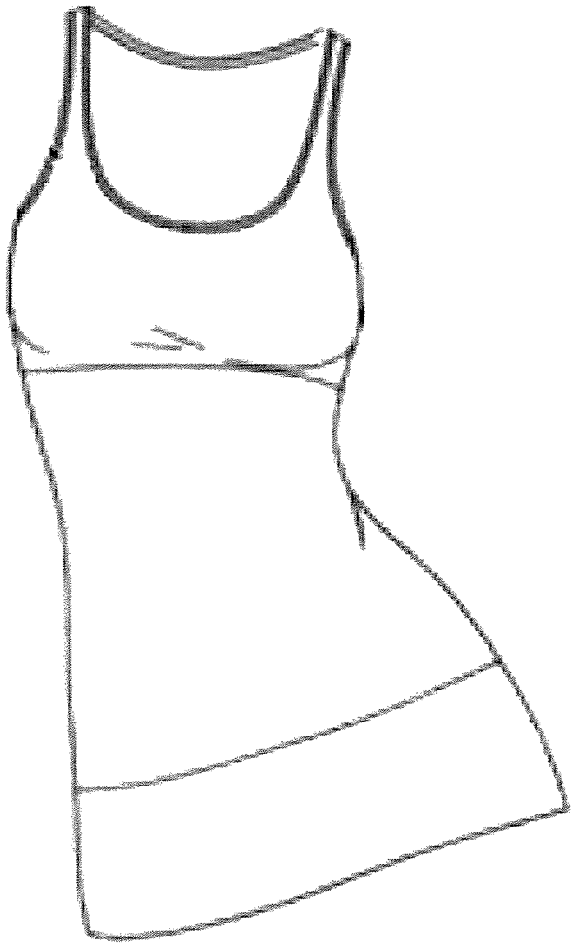
FIG. 34 illustrates a multi-fabric skinny tank garment according to an embodiment of the invention.

FIG. 34 illustrates a multi-fabric skinny tank garment according to an embodiment of the invention.

Although the present invention has been described and illustrated in the foregoing exemplary embodiments, it is understood that the present disclosure has been made only by way of example, and that numerous changes in the details of implementation of the invention may be made without departing from the spirit and scope of the invention.

What is claimed:

1. A multi-fabric women's garment for slenderizing the midsection of a user, shaping the waistline of the user, and minimizing the roll up of the garment over the abdomen area of the user, the garment comprising:

an upper section including a first substantially non-compressive shaper material;

a slenderizing middle section configured to be substantially horizontally around an abdomen of the user when worn and including a compressive material, where the compressive material is configured to slenderizes the abdomen of the user and shapes the waistline of the user;

a lower section including a second substantially non-compressive shaper material, where the lower section is configured to be used at least to position the garment over the abdomen area of the user; and a third material covering at least a portion of the slenderizing middle section, and concealing the at least a portion of the slenderizing middle section from the exterior of the multi-fabric garment.

2. The multi-fabric garment of claim 1, wherein the slenderizing middle section comprises the compressive material in a front portion of the garment and a fourth material is located in a back portion of the garment.

3. The multi-fabric garment of claim 1, wherein the third material covers at least a portion of the upper section, hiding at least a portion of the upper section from the exterior.

4. The multi-fabric garment of claim 3, wherein the third material covers all of the compressive material, hiding the compressive material from the exterior of the multi-fabric garment.

5. The multi-fabric garment of claim 1, wherein the slenderizing middle section substantially fully encompasses the abdominal area of the user.

6. The multi-fabric garment of claim 5, wherein the upper section has a tank top shape.

7. The multi-fabric garment of claim 6, wherein the tank top shape is a body contouring shaper tank top.

8. The multi-fabric garment of claim 7, further comprising a built in shelf bra.

9. The multi-fabric garment of claim 6, wherein the tank top shape is at least one of a halter top and racer bank.

10. The multi-fabric garment of claim 1, wherein the lower section is designed to be exposed for viewing while worn by the user.

11. The multi-fabric garment of claim 1, wherein the lower section is designed to be tucked into other clothes that cover a bottom portion of the user.

12. The multi-fabric garment of claim 1, wherein the upper section further comprises one or more adjustable straps.

13. The multi-fabric garment of claim 1, wherein the upper section further comprises an inner shelf bra.

14. The multi-fabric garment of claim 1, wherein the slenderizing middle section comprises a firm control microfiber.

15. The multi-fabric garment of claim 1, wherein the slenderizing middle section comprises at least one of micro denier fabric and Spandex.

16. The multi-fabric garment of claim 1, wherein the shape of the slenderizing middle section comprises a band.

17. The multi-fabric garment of claim 1, wherein one or more of the substantially non-compressive shaper materials comprise one or more of cotton, yarn, wool, polyester, viscose, and linen.

18. The multi-fabric garment of claim 1, wherein the first substantially non-compressive shaper material comprises a same material as the second substantially non-compressive shaper material.

19. The multi-fabric garment of claim 1, wherein the upper section comprises a tank top shape.

20. The multi-fabric garment of claim 19, wherein the tank top shape is at least one of a halter top and racer back.

21. A multi-fabric women's garment for slenderizing the midsection of a user, shaping the waistline of the user, and minimizing the roll up of the garment over the abdomen area of the user, the garment comprising:

an upper section including a first substantially non-compressive shaper material comprising a tank top shape with adjustable shoulder straps;

a slenderizing middle section configured to be substantially horizontally around an abdomen of the user when worn and including a compressive material comprising at least one of micro denier fabric and Spandex and sized to encompass the abdominal area of the user, and wherein the compressive material is configured to slenderize the abdomen of the user and shape the waistline of the user;

a lower section including a second substantially non-compressive shaper material, where the lower section is configured at least to position the garment over the abdomen area of the user and is designed to be exposed for viewing; and a third material completely covering the slenderizing middle section, and completely concealing the slenderizing middle section from the exterior while worn by the user.

22. The multi-fabric garment of claim 21, wherein the third material conceals at least a portion of the upper section from the exterior.

23. The multi-fabric garment of claim 21, wherein the third material conceals all of the upper section from the exterior.

24. The multi-fabric garment of claim 21, wherein the third material conceals at least a portion of the lower section of the exterior.

25. The multi-fabric garment of claim 21, wherein the third material is the same material of at least one of the first and the second non-compressive shaper materials.

26. A multi-fabric women's garment for slenderizing the midsection of a user, shaping the waistline of the user, and minimizing the roll up of the garment over the abdomen area of the user, the garment comprising:

an upper section including a first substantially non-compressive shaper fabric;

a lower section including a second substantially non-compressive shaper fabric, where the lower section is configured to position the garment over the abdomen area of the user and is designed to be exposed for viewing; and a compressive middle section configured to be substantially horizontally around an abdomen of the user when worn and including a compressive fabric comprising at least one of micro denier fabric and Spandex and sized to encompass the abdominal area of the user, wherein the compressive fabric is adapted to provide a compressive functionality that slenderizes the abdomen of the user and shapes the waistline of the user, and wherein the compressive material is not visible from the exterior of the garment when worn, and wherein the compressive fabric is joined to the first substantially non-compressive shaper fabric and the second substantially non-compressive shaper fabric.

27. The multi-fabric women's garment of claim 26, wherein the compressive middle section comprises the compressive fabric in a front portion of the garment and a third material is located in a back portion of the garment.

28. The multi-fabric women's garment of claim 26, further comprising a third material covering at least a portion of the upper section, hiding at least a portion of the upper section from the exterior.

29. The multi-fabric women's garment of claim 26, further comprising a third fabric covering all of the compressive middle section, hiding the compressive fabric from the exterior of the multi-fabric garment.

30. The multi-fabric women's garment of claim 26, wherein the compressive middle section substantially fully encompasses the abdominal area of the user.

31. The multi-fabric women's garment of claim 26, wherein the upper section has a tank top shape.

32. The multi-fabric women's garment of claim 31, wherein the tank top shape is a body contouring shaper tank top.

33. The multi-fabric women's garment of claim 32, further comprising a built in shelf bra.

34. The multi-fabric women's garment of claim 33, wherein the tank top shape is at least one of a halter top and racer bank.

35. The multi-fabric women's garment of claim 26, wherein the lower section is designed to be exposed for viewing while worn by the user.

36. The multi-fabric women's garment of claim 26, wherein the lower section is designed to be tucked into other clothes that cover a bottom portion of the user.

37. The multi-fabric women's garment of claim 26, wherein the upper section further comprises one or more adjustable straps.

38. The multi-fabric women's garment of claim 26, wherein the upper section further comprises an inner shelf bra.

39. The multi-fabric women's garment of claim 26, wherein the compressive middle section comprises a firm control microfiber.

40. The multi-fabric women's garment of claim 26, wherein the compressive middle section comprises at least one of micro denier fabric and Spandex.

41. The multi-fabric women's garment of claim 26, wherein the shape of the compressive middle section comprises a band.

42. The multi-fabric women's garment of claim 26, wherein one or more of the substantially non-compressive shaper fabrics comprise one or more of cotton, yarn, wool, polyester, viscose, and linen.

43. The multi-fabric women's garment of claim 26, wherein the first substantially non-compressive shaper fabric comprises a same material as the second substantially non-compressive shaper fabric.

44. The multi-fabric women's garment of claim 26, wherein the upper section comprises a tank top shape.

45. The multi-fabric women's garment of claim 32, wherein the tank top shape is at least one of a halter top and racer back.

46. The multi-fabric women's garment of claim 26, further comprising a third material covering all of the compressive middle section.

47. The multi-fabric women's garment of claim 26, further comprising a third material covering all of the compressive middle section and the lower section.

48. The multi-fabric women's garment of claim 26, further comprising a third material covering the upper section, the lower section, and the compressive middle section.

49. The multi-fabric garment of claim 1, wherein the third material conceals at least a portion of the lower section from the exterior.

50. The multi-fabric garment of claim 1, wherein the third material is the same material of at least one of the first and the second substantially non-compressive shaper materials.

51. The multi-fabric garment of claim 1, wherein the first substantially non-compressive shaper material comprises a different material as the second substantially non-compressive shaper material.

52. A multi section women's garment for slenderizing the midsection of a user, shaping the waistline of the user, and minimizing the roll up of the garment over the abdomen area of the user, the garment comprising:

an upper section including a first material comprising a first shaping characteristic;

a lower section including a second material comprising a second shaping characteristic, where the lower section is configured to be used at least to position the garment over the abdomen area of the user;

a slenderizing middle section configured to be substantially horizontally around an abdomen of the user when worn and providing an inward force on the body of the user, wherein the slenderizing middle section slenderizes or supports the abdomen of the user, shapes the abdomen of the user and includes a compressive inward force greater than the first and second shaping characteristics; and a third material covering at least a portion of the slenderizing middle section, and concealing the at least a portion of the slenderizing middle section from the exterior of the multi-fabric garment.

53. The multi-fabric women's garment of claim 52, wherein the slenderizing middle section comprises a compressive material in a front portion of the garment and the third material is located in a back portion of the garment.

54. The multi-fabric women's garment of claim 52, wherein the third material covers at least a portion of the upper section, hiding at least a portion of the upper section from the exterior.

55. The multi-fabric women's garment of claim 52, wherein the third material covers all of the slenderizing middle section, hiding the slenderizing middle section from the exterior of the multi-fabric garment.

56. The multi-fabric women's garment of claim 52, wherein the slenderizing middle section substantially fully encompasses the abdominal area of the user.

57. The multi-fabric women's garment of claim 52, wherein the upper section comprises a tank top shape.

58. The multi-fabric women's garment of claim 57, wherein the tank top shape is a body contouring shaper tank top.

59. The multi-fabric women's garment of claim 57, further comprising a built in shelf bra.

60. The multi-fabric women's garment of claim 57, wherein the tank top shape is at least one of a halter top and racer bank.

61. The multi-fabric women's garment of claim 52, wherein the lower section is designed to be exposed for viewing while worn by the user.

62. The multi-fabric women's garment of claim 52, wherein the lower section is designed to be tucked into other clothes that cover a bottom portion of the user.

63. The multi-fabric women's garment of claim 52, wherein the upper section further comprises one or more adjustable straps.

64. The multi-fabric women's garment of claim 52, wherein the upper section further comprises an inner shelf bra.

65. The multi-fabric women's garment of claim 52, wherein the slenderizing middle section comprises a firm control microfiber.

66. The multi-fabric women's garment of claim 52, wherein the slenderizing middle section comprises at least one of micro denier fabric and Spandex.

67. The multi-fabric women's garment of claim 52, wherein the shape of the slenderizing middle section comprises a band.

68. The multi-fabric women's garment of claim 52, wherein one or more of the sections comprise one or more of cotton, yarn, wool, polyester, viscose, and linen.

69. The multi-fabric women's garment of claim 52, wherein the first material comprises a same material as the second material.

70. The multi-fabric women's garment of claim 52, wherein the third material conceals at least a portion of the lower section from the exterior.

71. The multi-fabric women's garment of claim 52, wherein the third material is the same material of at least one of the first and the second materials.

72. The multi-fabric garment of claim 52, wherein the first material comprises a different material as the second material.

73. The multi-fabric women's garment of claim 52, wherein the third material covers all of the slenderizing middle section.

74. The multi-fabric women's garment of claim 52, wherein the third material covers all of the slenderizing middle section and the lower section.

75. The multi-fabric garment of claim 1, wherein the third material covers the upper section, the lower section, and the slenderizing middle section.

76. The multi-fabric garment of claim 1, wherein the third material covers all of the slenderizing middle section.

77. The multi-fabric garment of claim 1, wherein the third material covers all of the slenderizing middle section and the lower section.

* * * * *

UNITED STATES PATENT AND TRADEMARK OFFICE

CERTIFICATE OF CORRECTION

PATENT NO. : 8,568,195 B1
APPLICATION NO. : 12/353752
DATED : October 29, 2013
INVENTOR(S) : Heather Thomson Schindler It is certified that error appears in the above-identified patent and that said Letters Patent is hereby corrected as shown below:

Title Page:

Item 56 under "References Cited, U.S. Patent Documents," 7th line:

Please change "1,249,446 A * 12/1917 McGill" to: --1,249,446 A * 12/1917 Mell--.

On page 2, Column one, under "References Cited, U.S. Patent Documents," 23rd line:

Please change "3,479,844 A * 11/1969 Andre" to: --3,479,844 A * 11/1969 Silvain--.

In the specification:

Column 4, line 50, after "inches", change "form" to --from--.

Column 5, line 53, after "FIGS. 6", change "though" to --through--.

In the claims:

Claim 1, Column 7, line 30, change "slenderizes" to --slenderize--.

Claim 1, Column 7, line 31, change "shapes" to --shape--.

Signed and Sealed this
Twenty-fourth Day of December, 2013

Margaret A. Focarino

Margaret A. Focarino
*Commissioner for Patents of the United States Patent and Trademark Office*